US005192649A

United States Patent [19]

Hirano et al.

[11] Patent Number: 5,192,649

[45] Date of Patent: Mar. 9, 1993

[54] COLOR DIFFUSION TRANSFER LIGHT-SENSITIVE MATERIAL

[75] Inventors: Katsumi Hirano; Munehisa Fujita; Katsuhisa Ohzeki, all of Kanagawa, Japan

[73] Assignee: Fuji Photo Film Co., Ltd., Kanagawa, Japan

[21] Appl. No.: 787,594

[22] Filed: Nov. 4, 1991

[30] Foreign Application Priority Data

Nov. 5, 1990 [JP] Japan ..... 2-299262

[51] Int. Cl.[5] ..... G03C 5/54

[52] U.S. Cl. ..... 430/497; 430/217; 430/218; 430/223; 430/506; 430/509; 430/559; 430/214

[58] Field of Search ..... 430/223, 217, 218, 214, 430/509, 506, 559, 497

[56] References Cited

U.S. PATENT DOCUMENTS

| | | | |
|---|---|---|---|
| 4,015,989 | 4/1977 | Oishi et al. | 430/217 |
| 4,139,379 | 2/1979 | Chasman et al. | 430/223 |
| 4,539,289 | 9/1985 | Saito et al. | 430/509 |
| 4,772,542 | 9/1988 | Haga | 430/509 |
| 4,783,396 | 11/1988 | Nakamura et al. | 430/223 |

*Primary Examiner*—Richard L. Schilling
*Attorney, Agent, or Firm*—Sughrue, Mion, Zinn, Macpeak & Seas

[57] ABSTRACT

A color diffusion transfer light-sensitive material comprising a support having thereon light-sensitive silver halide emulsions and an electron donor in combination with reducible dye providing compounds each of which releases a diffusible dye when reduced and further a silver halide emulsion having substantially no light sensitivity in addition to the light-sensitive silver halide emulsions.

4 Claims, No Drawings

COLOR DIFFUSION TRANSFER LIGHT-SENSITIVE MATERIAL

FIELD OF THE INVENTION

This invention relates to a color diffusion transfer process, and more particularly to a color diffusion transfer process for forming a positive image by combining a nondiffusible compound (called a positive dye providing compound) which releases a diffusible dye in counter-relation to a reaction which reduces silver halide to silver, with a general negative type silver halide emulsion. Still more particularly, it relates to a color diffusion transfer process for forming a positive image having a low minimum density.

BACKGROUND OF THE INVENTION

Methods for forming directly a positive image using a color diffusion transfer process include (A) a method wherein direct positive silver halide emulsions are used in combination with a nondiffusible compound (called a negative dye providing compound) which releases a diffusible dye in relation to a reaction which reduces silver halide to silver; and (B) a method wherein general silver halide emulsions (silver halide emulsions which undergo negative-positive response) are used in combination with a nondiffusible compound which itself becomes diffusible in counter-relation to a reaction which reduces silver halide to silver, or a nondiffusible compound (called a positive dye providing compound) which releases a diffusible dye in counter-relation to a reaction which reduces silver halide to silver.

In method (A), compounds (DDR couplers) which are couplers having a diffusible dye as a split-off group and release a diffusible dye by the coupling reaction with the oxidation products of reducing agents as described in U.K. Patent 1,330,524, JP-B-48-39165 (the term "JP-B" as used herein means an "examined Japanese patent publication") and U.S. Pat. Nos. 3,443,940, 4,474,867 and 4,483,912; and compounds (DRR compounds) which are capable of reducing silver halide and release a diffusible dye when silver halide is reduced as described in U.S. Pat. Nos. 3,928,312, 4,053,312, 4,055,428 and 4,336,322 are used.

In method (B), the following compounds are used:

(1) dye developing agents wherein a hydroquinone developing agent and a dye component are bonded to each other (the dye developing agents are diffusible under alkaline conditions, but become nondiffusible when reacted with silver halide) as described in U.S. Pat. Nos. 3,134,764, 3,362,819, 3,597,200, 3,544,545 and 3,482,972;

(2) nondiffusible compounds which release a diffusible dye under alkaline conditions, but lose the ability to release the dye when reacted with silver halide as described in U.S. Pat. No. 4,503,137, compounds which release a diffusible dye by an intramolecular nucleophilic displacement reaction as described in U.S. Pat. No. 3,980,479, and compounds which release a diffusible dye by the intramolecular rewinding reaction of isoxazolones as described in U.S. Pat. No. 4,199,354; and (3) nondiffusible compounds which release a diffusible dye by the reaction with a reducing agent remaining without being oxidized by development as described in U.S. Pat. No. 4,559,290, European Patent 220,746A2, U.S. Pat. Nos. 4,783,396 and Kokai Giho 87-6199.

When the above two methods are compared, method (B) is preferable from the viewpoint of easily achieving high sensitivity. However, method (B) has a problem in that there is a difficulty in reducing the density of the minimum density area which is of great importance for image formation.

In method (B), the minimum density of the positive image is determined by a competitive reaction between the dye release due to the reaction of a reducible dye providing compound with an electron donor and the oxidation of the electron donor by the oxidation product (formed by development of silver halide) of an electron transfer agent. Accordingly, the formation of the oxidation product of the electron transferring agent is appropriately adjusted by controlling the development of light-sensitive silver halide to a lower minimum density. Specifically, a light-sensitive silver halide which can be rapidly developed is used to expedite the formation of the oxidation product of the electron transferring agent, and the use of a precursor of the electron donor has been disclosed (see, JP-A-3-131848 (the term "JP-A" as used herein means an "unexamined published Japanese patent application")). However, these methods are methods which have an effect on dye release which occurs at an early stage of development. It has been found that the minimum density of a sufficiently satisfactory positive image can not be achieved only by these methods. The present invention is directed to a method having an effect on dye release which occurs at a latter stage of development.

SUMMARY OF THE INVENTION

An object of the present invention is to achieve a low minimum density in instant color diffusion transfer light-sensitive materials using reducible dye providing compounds.

The above object of the present invention has been achieved by providing a color diffusion transfer light-sensitive material which comprises a support having thereon light-sensitive silver halide emulsions and an electron donor in combination with reducible dye providing compounds each of which releases a diffusible dye when reduced and further a silver halide emulsion having substantially no light sensitivity present in an arbitrary layer or layers in addition to the light-sensitive silver halide emulsions.

DETAILED DESCRIPTION OF THE INVENTION

The present invention is illustrated in more detail below.

The term "silver halide emulsion having substantially no light sensitivity" as used herein refers to a specific silver halide emulsion that when a photographic material formed by removing a light-sensitive silver halide emulsion from a light-sensitive material containing the light-sensitive silver halide emulsion and the optical density of this specific silver halide emulsion is measured, the optical density of the photographic material containing only the specific silver halide emulsion after exposure with an exposure amount of $\log I = \log I_0 + 0.5$ (wherein $I_0$ is the minimum exposure amount providing the minimum density of a positive image formed by the light-sensitive emulsion present in the light-sensitive material) and the optical density of the photographic material before exposure are identical with each other within the range of ±10%.

The silver halide emulsion having substantially no light sensitivity which can be used in the present invention may comprise any of silver chloride, silver bromide, silver iodobromide, silver chlorobromide, silver chloroiodide and silver chloroiodobromide, so long as they satisfy the above-described conditions. The halogen composition within the grain may be uniform or may comprise a multiple structure wherein the surface layer of the grain and the interior thereof have a different halogen composition (see, JP-A-57-154232, JP-A-58-108533, JP-A-59-48755, JP-A-59-52237, U.S. Pat. No. 4,433,048 and European Patent 100,984). Monodisperse emulsions wherein grain size distribution is nearly uniform (as described in JP-A-57-178235, JP-A-58-100846, JP-A-58-14829, WO (PCT) 83/02338A, European Patents 64,412A3 and 83,377A1) may be used.

Two or more silver halides with different crystal habits, halogen compositions, grain sizes and grain size distributions may be used in combination, if desired.

With regard to the grain size of the silver halide having substantially no light sensitivity, the mean grain size is preferably 0.001 to 10 μm, more preferably 0.1 to 0.3 μm.

The silver halide emulsion having substantially no light sensitivity may be prepared using any of the acid process, the neutral process and the ammonia process. A soluble silver salt and a soluble halide can be reacted using any of the single jet process, the double jet process or a combination thereof. A reverse mixing method in which grains are formed in the presence of an excess of silver ion, or a controlled double jet process in which pAg is kept constant can also be used. The concentrations and amounts of the silver salt and the halide to be added may be increased to expedite the growth rate of the grains (see, JP-A-55-142329, JP-A-55-158124, U.S. Pat. No. 3,650,757).

Silver halide grains formed by epitaxial growth can also be used (see, JP-A-56-16124, U.S. Pat. No. 4,094,684).

Ammonia, organic thioether derivatives (described in JP-B-47-11386) or sulfur-containing compounds (described in JP-A-53-144319) can be used as solvents for silver halide during the formation of the silver halide grains having substantially no light sensitivity which are used in the present invention.

Cadmium salts, zinc salts, lead salts or thallium salts may be present during the course of the formation of the grains or the physical ripening of the grains.

Further, water-soluble iridium salts such as iridium chloride(III, IV) and ammonium hexachloroiridate or water-soluble rhodium salts such as rhodium chloride can be used.

Soluble salts may be removed from the silver halide emulsion after the formation of the grains or after the physical ripening of the grains. The soluble salts can be removed by noodle washing or a precipitation method.

The silver halide emulsion having substantially no light sensitivity is generally used in an un-after-ripened condition. However, a sulfur sensitization method, reduction sensitization method and noble metal sensitization method which are conventionally used for the sensitization of emulsions for conventional light-sensitive materials can be used alone or in combination and this is within the scope of conditions which meet the requirements of the present invention.

The silver halide grains having substantially no light sensitivity which are used in the present invention can be formed by the conventional single jet process or the double jet process. In the latter process a controlled double jet process in which the pAg in the reaction mixture is kept constant can also be used. Further, a combination of these processes may be used. In the above-described processes for forming silver halide emulsions, any of the conventional one-stage addition method and the multi-stage addition method may be used, and the addition rate may be kept constant or may be changed stepwise or continuously (for example by a method wherein the flow rates of the soluble silver salt solution and the halide solution are changed while the concentrations of the soluble salt and/or the halide are kept constant; a method wherein the concentrations of the soluble silver salt and/or the halide in the solutions to be added are changed while the flow rate is kept constant; and a method using a combination of the above methods).

The solutions to be reacted may be stirred using any known stirring methods. Further, the temperature and pH of the solutions may be arbitrarily set during the formation of the silver halide grains.

The coating weight of the silver halide having substantially no light sensitivity according to the present invention is in the range of 5 to 200%, preferably 50 to 100%, in terms of silver, of the amount of the light-sensitive silver halide.

The silver halide emulsion having substantially no light sensitivity which is used in the present invention may contain various anti-fogging agents or photographic stabilizers. Examples of anti-fogging agents and stabilizers which can be used include azoles and azaindenes described in *Research Disclosure* (RD), No. 17643, pp. 24–25 (1978), nitrogen-containing carboxylic acids and phosphoric acids described in JP-A-59-168442, mercapto compounds and metal salts thereof described in JP-A-59-111636 and acetylene compounds described in JP-A-62-87957.

The silver halide having substantially no light sensitivity according to the present invention may be present in the light-sensitive silver halide emulsion layers or in layers (e.g., dye providing compound layer) adjacent thereto.

Each constituent layer of the present invention is illustrated in detail below.

(A) SUPPORT

Supports which can be used in the present invention include photographic smooth supports which are conventionally used, such as transparent supports, white supports and black supports. Examples of suitable transparent supports include polyethylene terephthalate, cellulose acetate and polycarbonates, each having a thickness of 50 to 350 μm, preferably 70 to 210 μm. A slightly turbid amount of a pigment such as titanium dioxide or a very small amount of a dye may be incorporated in the transparent supports to thereby prevent light piping from occurring.

The term "white support" as used herein refers to supports where at least a side on which a dye image-receiving layer is coated is white. Any of the white supports can be used, so long as they have sufficient whiteness and smoothness. Suitable white supports include polymer films which are whitened by adding a white pigment having a particle size of 0.1 to 5μ such as titanium oxide, barium sulfate or zinc oxide or by forming microvoids by orientation. Preferred examples of such polymer films include films obtained by biaxially orienting a film of polyethylene terephthalate, films obtained from polystyrene or polypropylene, synthetic paper, and polyolefin-laminated paper obtained by laminating both sides of a paper with polyethylene, polyethylene terephthalate or polypropylene. The laminate layer may contain a white pigment such as titanium white.

The thickness of the support is 50 to 350 μm, preferably 70 to 210 μm, more preferably 80 to 150 μm. If desired, a light-intercepting layer can be provided on the support. For example, supports obtained by laminating the back side of a white support with polyethylene containing a light intercepting agent such as carbon black can be used.

Preferred examples of black supports include polyethylene terephthalate, cellulose acetate, polycarbonates, polystyrene and polypropylene, each containing a light intercepting agent such as carbon black and having a thickness of 50 to 350 μm, preferably 70 to 210 μm; and polyolefin-laminated paper supports obtained by laminating both sides of a paper support containing a light-intercepting agent such as carbon black and having a thickness of 50 to 400 μm, preferably 70 to 250 μm with polyethylene, polyethylene terephthalate or polypropylene.

Carbon blacks prepared by the channel process, the thermal process and the furnace process as described in Donnel Voest, *Carbon Black*, Marcal Dekker, Inc, (1976) can be used. The particle size of the carbon black is preferably 90 to 1800Å, although there is no specific limitation with respect to particle size. The amount of the black pigment as a light intercepting agent to be added may be controlled depending on the sensitivity of the light-sensitive material to be light-intercepted. Preferably, the black pigment is used in such an amount which provides an optical density of 5 to 10. When a black support is used or when the whiteness of a white support is insufficient, a white light reflecting layer can be provided between the support and the dye image receiving layer. It is preferred that a layer containing a white pigment having a particle size of 0.1 to 5μ such as titanium oxide, barium sulfate or zinc oxide or hollow polymer latex be provided.

(B) LAYER HAVING A NEUTRALIZATION FUNCTION

A layer having a neutralization function which is used in the present invention is a layer containing an acid material in an amount sufficient to neutralize alkalis carried over from a processing composition. If desired, the layer may have a multi-layer structure comprising a neutralization rate controlling layer (timing layer), an adhesion-strengthening layer, etc. Preferred acid materials are those having an acidic group with a pK of not higher than 9 (or a precursor group producing such an acidic group by hydrolysis). More preferred are higher fatty acids such as oleic acid described in U.S. Pat. No. 2,983,606; polymers of acrylic acid, methacrylic acid or maleic acid, or partial esters thereof or acid anhydrides thereof described in U.S. Pat. No. 3,362,819; copolymers of acrylic acid with an acrylic ester described in French Patent 2,290,699; and latex type acid polymers described in U.S. Pat. No. 4,139,383 and *Research Disclosure* No. 16102 (1977).

Further, acidic materials described in U.S. Pat. No. 4,088,493, JP-A-52-153739, JP-A-53-1023, JP-A-53-4561 and JP-A-53-4542 can be used.

Examples of polymer acids include copolymers of a vinyl monomer such as ethylene, vinyl acetate or vinyl methyl ether with maleic anhydride; copolymers of n-butyl eater such as butyl acrylate with acrylic acid; cellulose acetate and hydrogen phthalates.

The above described polymer acids can be used alone or in admixture with a hydrophilic polymer. Examples of suitable polymers include polyacrylamide, polyvinyl pyrrolidone, polyvinyl alcohol (including partial saponified products), carboxymethyl cellulose, hydroxymethyl cellulose, hydroxyethyl cellulose and polymethyl vinyl ether. Among them, polyvinyl alcohol is preferred.

Further, the polymer acids may be mixed with a polymer such as cellulose acetate other than the above-described hydrophilic polymers.

The coating weights of the polymer acids are dependent on the amount of the alkali to be spread over the light-sensitive element. The ratio of equivalents of the polymer acid to equivalent of alkali per unit area is preferably 0.9~2.0. When the amount of the polymer acid is too small, disadvantages occur in that the hue of the transfer dye is altered or stain is formed on the white area, while when the amount is too large, disadvantages occur in that the hue is altered or light resistance is lowered. A more preferred equivalent ratio is 1.0~1.3. When the polymer acids are used as a mixture with a hydrophilic polymer, the quality of the photographs is lowered when the amount of the hydrophilic polymer is too large or too small. The ratio by weight of the hydrophilic polymer to the polymer acid is 0.1~10, preferably 0.3~3.0.

The layer having a neutralization function used in the present invention may contain additives for various purposes. For example, the layer may contain conventional hardening agents to harden the layer. Polyhydroxyl compounds such as ethylene glycol, polypropylene glycol and glycerin may be present in the layer to improve the brittleness of the layer. Further, antioxidants, restrainers or precursors thereof may be optionally present.

(C) NEUTRALIZATION TIMING LAYER

The timing layer used in combination with the neutralization layer comprises, for example, a polymer which reduces alkali permeability such as gelatin, polyvinyl alcohol, partially acetalized polyvinyl alcohol, cellulose acetate and partially hydrolyzed polyvinyl acetate; latex polymers which elevate the activation energy of alkali permeation, obtained by copolymerizing a small amount of a hydrophilic comonomer such as an acrylic acid monomer; and a polymer having a lactone ring.

Particularly useful timing layers are those using cellulose acetate as described in JP-A-54-136328, U.S. Pat. Nos. 4,267,262, 4,009,030 and 4,029,849; latex polymers prepared by copolymerizing a small amount of a hydrophilic comonomer such as acrylic acid as described in JP-A-54-128335, JP-A-56-69629, JP-A-57-6843, U.S. Pat. Nos. 4,056,394, 4,061,496, 4,199,362, 4,250,243, 4,256,827 and 4,268,604; polymers having a lactone ring as described in U.S. Pat. No. 4,229,516; and polymers described in JP-A-56-25735, JP-A-56-97346, JP-A-57-6842, European Patents 31,957Al, 37,724Al and 48,412Al.

Further, materials described in U.S. Pat. Nos. 3,421,893, 3,455,686, 3,575,701, 3,778,265, 3,785,815, 3,847,615, 4,088,493, 4,123,275, 4,148,653, 4,201,587, 4,288,523 and 4,297,431, West German Patent Application (OLS) Nos. 1,622,936 and 2,162,277, *Research Disclosure* 5,162 No. 151 (1976), JP-A-59-202463, U.S. Pat. Nos. 4,297,431, 4,288,523, 4,201,587 and 4,229,515, JP-A-55-121438, JP-A-56-166212, JP-A-55-41490, JP-A-55-54341, JP-A-56-102851, JP-A-57-141644, JP-A-57-173834, JP-A-57-179841, West German Patent Laid Open (OLS) No. 2,910,271, EP 31957Al and *Research Disclosure No.* 18452 can be used.

The neutralization timing layer may comprise a single layer or two or more layers.

Restrainers described in U.S. Pat. No. 4,009,029, West German Patent Application (OLS) Nos. 2,913,164 and 3,014,672, JP-A-54-155837 and JP-A-55-138745 and/or precursors thereof or hydroquinone precursors and other photographic useful additives or precursors thereof described in U.S. Pat. No. 4,201,578 can be present in timing layers comprising these materials.

(D) DYE IMAGE RECEIVING LAYER

The dye image receiving layer used in the present invention comprises a mordant in a hydrophilic colloid. The dye image receiving layer may comprise a single layer or may have a multi-layer structure wherein mordants with different degrees of mordanting capability are coated in a superposed form as described in JP-A-61-252551. Polymer mordants are preferred as mordants.

Suitable polymer mordants which can be used in the present invention include polymers having secondary and tertiary amino groups, polymers having a nitrogen-containing heterocyclic ring moiety and polymers having a quaternary cationic group. Suitable polymers have a molecular weight of not less than 5,000, preferably not less than 10,000.

Examples of suitable polymers include vinyl pyridine polymers and vinylpyridinium cationic polymers described in U.S. Pat. Nos. 2,548,564, 2,484,430, 3,148,061 and 3,756,814; vinyl imidazolium cationic polymers described in U.S. Pat. No. 4,124,386; polymer mordants capable of crosslinking with gelatin as described in U.S. Pat. Nos. 3,625,694, 3,859,096 and 4,128,538 and U.K. patent 1,277,453; aqueous sol type mordants described in U.S. Pat. Nos. 3,958,995, 2,721,852 and 2,798,063, JP-A-54-115258, JP-A-54-145529, JP-A-54-126027, JP-A-54-155838 and JP-A-56-17352; water-insoluble dyes described in U.S. Pat. No. 3,898,088; reactive dyes capable of forming covalent bonds with dyes as described in U.S. Pat. Nos. 4,168,976 and 4,201,840; and mordants described in U.S. Pat. Nos. 3,709,690, 3,788,855, 3,642,482, 3,488,706, 3,557,066, 3,271,147 and 3,271,148, JP-A-53-30328, JP-A-52-155528, JP-A-53-125, JP-A-53-1024 and JP-A-53-107835 and U.K. Patent 2,064,802.

In addition, the mordants described in U.S. Pat. Nos. 2,675,316 and 2,882,156 can be used.

Among these mordants, those which are difficultly transferred from the mordant layer to another layer are preferable. For example, mordants capable of crosslinking with the matrix such as gelatin, water-insoluble mordants and aqueous sol (or latex dispersion) type mordants are preferred. Particularly preferred are latex dispersion mordants. The particle size of these dispersions is 0.01 to 2$\mu$, preferably 0.05 to 0.2$\mu$.

The amount of mordant coated varies depending on the types of mordant used, the content of quaternary cationic groups, the types and amounts of dyes to be mordanted and the types of binders to be used, but is generally 0.5 to 10 g/m$^2$, preferably 1.0 to 5.0 g/m$^2$, particularly preferably 2 to 4 g/m$^2$.

Examples of suitable hydrophilic colloids which can be used in the image receiving layer include gelation, polyvinyl alcohol, polyacrylamide and polyvinyl pyrrolidone. Gelatin is preferable.

The image receiving layer may contain anti-fading agents. Examples of suitable anti-fading agents include antioxidants, ultraviolet light absorbers and certain metal complexes. These agents may be present in other layers if these agents are ultimately substantially present in the image receiving layer and have an effect.

Examples of typical antioxidants include chroman compounds, coumaran compounds, phenolic compounds (e.g., hindered phenols), hydroquinone derivatives, hindered amine derivatives and spiro-indane compounds. The compounds described in JP-A-61-159644 are also effective.

Examples of appropriate ultraviolet light absorbers include benztriazole compounds (described in U.S. Pat. No. 3,533,794), 4-thiazolidone compounds (described in U.S. Pat. No. 3,352,681), benzophenone compounds (described in JP-A-46-2784) and compounds described in JP-A-54-48535, JP-A-62-136641 and JP-A-61-88256. Further, ultraviolet light absorbing polymers described in JP-A-62-260152 are also effective.

Examples of usable metal complexes include compounds described in U.S. Pat. Nos. 4,241,155, 4,245,018 (3rd column to 36th column) and 4,254,195 (3rd column to 8th column), JP-A-62-174741, JP-A-61-88256 (pp. 27~29), JP-A-1-75568 and JP-A-63-199248.

Examples of useful anti-fading agents are also described in JP-A-62-215274 (pp. 125~127).

Anti-fading agents to prevent the dyes transferred to the image receiving element from fading may be present in the image receiving element or may be supplied to the image receiving element from an external source such as a light-sensitive element or a processing composition.

The above-described antioxidants, ultraviolet light absorbers and metal complexes may be used in combination, if desired.

The light-sensitive element and the image receiving element may contain a fluorescent brightening agent. It is preferred that the fluorescent brightening agent is present in the image receiving element or is fed to the image receiving element during processing by incorporating the agent in the light-sensitive element or the processing composition. Examples of suitable agents include compounds described in K. Veenkataraman, *The Chemistry of Synthetic Dyes*, Vol. V, chapter 8, and JP-A-61-143752. More specifically, typical examples of the compounds include stilbene compounds, coumarin compounds, biphenyl compounds, benzoxazolyl compounds, naphthalimide compounds, pyrazoline compounds and carbostyril compounds.

The fluorescent brightening agents and the anti-fading agents may be used in combination, if desired.

(E) RELEASE LAYER

A release layer may be provided in the present invention to facilitate peeling of the light-sensitive element and the image receiving element from each other after processing. Accordingly, the release layer should be one which can be easily peeled off after processing. Examples of suitable materials for the release layer include those described in JP-A-47-8237, JP-A-59-220727, JP-A-59-229555, JP-A-49-4653, U.S. Pat. Nos. 3,220,835 and 4,359,518, JP-A-49-4334, JP-A-56-65133, JP-B-45-24075, U.S. Pat. Nos. 3,277,550, 2,759,835, 4,401,746 and 4,366,227. More specifically, typical examples of these materials include water-soluble (or alkali-soluble) cellulose derivatives such as hydroxyethyl cellulose, cellulose acetate phthalate, plasticized methyl cellulose, ethyl cellulose, cellulose nitrate and carboxyethyl cellulose. Other examples thereof are various natural high-molecular weight materials such as alginic acid, pectin and gum arabic. Various modified gelatins such as acetylated gelatin and phthalated gelatin can also be used. Furthermore, water-soluble polymers such as polyvinyl alcohol, polyacrylates, polymethyl methacrylate, polybutyl methacrylate and copolymers thereof can be used.

The release layer may comprise a single layer or two or more layers as described in JP-A-59-220727 and JP-A-60-60642.

(F) LIGHT-SENSITIVE LAYER

A light-sensitive layer comprising silver halide emulsion layers in combination with a dye image forming material is provided in the present invention. The constituent elements thereof are illustrated below.

(1) DYE IMAGE FORMING MATERIAL

The dye image forming material (hereinafter referred to as reducible dye providing compound) used in the present invention, itself does not release a dye in relation to silver development, but releases a dye when the material is reduced. When a compound of this type is used in combination with an electron donor, a diffusing dye can be released in an imagewise manner by the reaction of an electron donor left over after imagewise oxidation during silver development. Atomic groups having such a function are described in U.S. Pat. Nos. 4,183,753, 4,142,891, 4,278,750, 4,139,379 and 4,218,368, JP-A-53-110827, U.S. Patents 4,278,750, 4,356,249 and 4,358,525, JP-A-53-110827, JP-A-54-130927, JP-A-56-164342, U.S. Pat. No. 4,783,396, Kokai Giho 87-6199 and European Patent Laid-Open No. 220746A2.

Reducible dye providing compounds which can be advantageously used in the present invention are compounds represented by the following general formula (C-I).

$$\text{PWR}-(\text{Time})_t-\text{Dye} \qquad \text{(C-I)}$$

wherein PWR represents a group which releases $-(\text{Time})_t-\text{Dye}$ when the compound is reduced; Time represents a group which releases Dye through a subsequent reaction after $-(\text{Time})_t-\text{Dye}$ is released from PWR; t represents an integer of 0 or 1; and Dye represents a dye or a precursor thereof.

First, PWR is illustrated in detail below.

PWR may be a group corresponding to a moiety having an electron accepting center and an intramolecular nucleophilic substitution reaction center in compounds which release a photographically useful reagent as a result of an intramolecular nucleophilic substitution reaction after reduction as described in U.S. Pat. Nos. 4,139,389, 4,139,379 and 4,564,577, JP-A-59-185333 and JP-A-57-84453; a group corresponding to a moiety having an electron accepting quinonoid center and a carbon atom through which a photographically useful reagent is bound to this center as in compounds which eliminate the photographically useful reagent as a result of an intramolecular electron transfer reaction after reduction as described in U.S. Pat. No. 4,232,107, JP-A-59-101649, *Research Disclosure* (1984) IV, 24025 and JP-A-61-88257; a group corresponding to a moiety having an electron attractive group-substituted aryl group and an atom (a sulfur atom, a carbon atom or a nitrogen atom) through which a photographically useful reagent is bonded to this aryl group as in compounds which release the photographic reagent as a result of cleavage of a single bond after reduction as described in JP-A-56-142530, U.S. Pat. Nos. 4,343,893 and 4,619,884; a group corresponding to a moiety having nitro group and carbon atom through which a photographically useful reagent is bonded to this nitro group as in nitro compounds which release the photographically useful reagent as a result of electron acceptance as described in U.S. Pat. No. 4,450,223; and a group corresponding to a moiety having a geminal dinitro moiety and carbon atom through which a photographically useful reagent is bonded to the dinitro moiety as in dinitro compounds which allow the photographic reagent to be released as a result of $\beta$-elimination after electron acceptance as described in U.S. Pat. No. 4,609,610.

Other examples of PWR include compounds having an $SO_3$-X bond (wherein X is any of an oxygen, sulfur and nitrogen atom) and an electron attractive group in the same molecule as described in U.S. Pat. No. 4,840,887; compounds having a PD-X bond (wherein X is as defined above) and an electron attractive group in the same molecule as described in JP-A-63-271344; and compounds having an C-$X^1$ bond (wherein $X^1$ is the same as X or is $-SO_2-$) and an electron attractive group in the same molecule as described in JP-A-63-271341.

Among the compounds of general formula (C-I), compounds represented by the following general formula (C-II) are preferred to achieve the objects of the present invention.

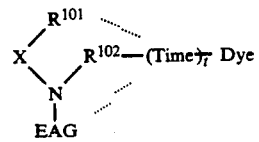

(C-II)

Wherein $(\text{Time})_t$Dye is bonded to at least one of $R^{101}$, $R^{102}$ and EAG.

The moiety corresponding to PWR in general formula (C-II) is illustrated below.

X represents an oxygen atom (—O—), a sulfur atom (—S—) or a nitrogen atom in the group ($-N(R^{103})-$).

$R^{101}$, $R^{102}$ and $R^{103}$ represent each a group, other than a hydrogen atom or a single bond.

Examples of groups represented by $R^{101}$, $R^{102}$ and $R^{103}$ other than a hydrogen atom include an alkyl group, an aralkyl group, an alkenyl group, an alkynyl group, an aryl group, a heterocyclic group, a sulfonyl group, a carbamoyl group and a sulfamoyl group. These groups may optionally include one or more substituent groups.

Preferably, $R^{101}$, $R^{102}$ and $R^{103}$ are each a substituted or unsubstituted alkyl group, a substituted or unsubstituted alkenyl group, a substituted or unsubstituted alkynyl group, a substituted or unsubstituted aryl group, a substituted or unsubstituted heterocyclic group, a substituted or unsubstituted acyl group or a substituted or unsubstituted sulfonyl group. Preferably, $R^{101}$ and $R^{103}$ have each 1 to 40 carbon atoms.

Preferably, $R^{102}$ is a substituted or unsubstituted acyl group or a substituted or unsubstituted sulfonyl group. Preferably, $R^{102}$ has 1 to 40 carbon atoms.

$R^{101}$, $R^{102}$ and $R^{103}$ may combine together to form a five-membered to eight-membered heterocyclic group.

Particularly preferably, X is oxygen.

EAG is illustrated hereinafter.

Among the compounds of general formula (C-II), compounds represented by the following general formula (C-III) are preferred to achieve the objects of the present invention.

(C-III)

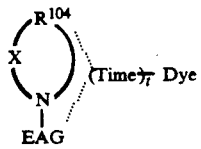

Wherein (Time)$_\pi$Dye is bonded to at least one of $R^{104}$ and EAG.

X is the same as defined above.

$R^{104}$ represents an atomic group which is bonded to a nitrogen atom to thereby form a nitrogen-containing five-membered to eight-membered monocyclic or condensed heterocyclic ring.

In general formulas (C-II) and (C-III), EAG represent a group which accepts an electron from a reducing material and is bonded to a nitrogen atom. A group represented by the following general formula (A) is preferred as EAG.

(A)

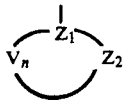

In general formula (A), $Z_1$ represents

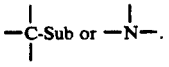

$V_n$ represents an atomic group which forms a three-membered to eight-membered aromatic ring together with $Z_1$ and $Z_2$, and n represents an integer of 3 to 8.

$V_3$ is $-Z_3-$, $V_4$ is $-Z_3-Z_4-$, $V_5$ is $-Z_3-Z_4-Z_5-$, $V_6$ is $-Z_3-Z_4-Z_5-Z_6-$, $V_7$ is $-Z_3-Z_4-Z_5-Z_6-Z_7-$, and $V_8$ is $-Z_3-Z_4-Z_5-Z_6-Z_7-Z_8-$.

$Z_2$ to $Z_8$ represent each

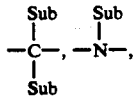

—O—, —S—, or $—SO_2—$. Sub represents each a single bond (a $\pi$ bond), a hydrogen atom or a substituent group described below. Sub may be the same or different groups or may combine together to form a three-membered to eight-membered saturated or unsaturated carbocyclic ring or heterocyclic ring.

In general formula (A), Sub is/are chosen so that the sum total of $\sigma$ and $\rho$ values of the Hammett's substituent constant of substituent groups is preferably at least +0.50, more preferably at least +0.70, most preferably at least +0.85.

Preferably, EAG is an aryl or heterocyclic group which is substituted by at least one electron attractive group. The substituent group to which the aryl group or heterocyclic group of EAG is bonded can be utilized to control the physical properties of the entire compound. Examples of control of the overall physical properties of the compound include controlling of the ease of electron acceptance, water-solubility, oil-solubility, diffusibility, sublimation, melting point, dispersibility in binders such as gelatin, reactivity with nucleophilic groups and reactive groups to electrophilic groups.

Specific examples of EAG are described in U.S. Pat. No. 4,783,396 and European Patent 220746A2 (pages 6–7).

Time represents a group which releases Dye through a subsequent reaction caused by the cleavage of a nitrogen-oxygen bond, a nitrogen-nitrogen bond or a nitrogen-sulfur bond.

The group represented by Time is known. Examples of suitable groups include those described in JP-A-61-147244 (pp. 5–6), JP-A-61-236549 (pp. 8–14) and JP-A-62-215270.

The dye represented by Dye may be a dye or a dye precursor which can be converted into a dye during photographic processing or an additional processing stage. Further, the final image dye may be metal-chelated dyes and dyes which are not metal-chelated, such as azo dyes, azomethine dyes, anthraquinone dyes and phthalocyanine dyes. Among them, azo type cyan, magenta and yellow dyes are particularly useful.

Examples of suitable yellow dyes include those described in U.S. Pat. Nos. 3,597,200, 3,309,199, 4,013,633, 4,245,028, 4,156,609, 4,139,383, 4,195,992, 4,148,641, 4,148,643 and 4,336,322, JP-A-51-114930, JP-A-56-71072, *Research Disclosure* No. 17630 (1978) and ibid., No. 16475 (1977).

Examples of suitable magenta dyes include those described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104 and 4,287,292, JP-A-52-106727, JP-A-53-23628, JP-A-55-36804, JP-A-56-73057, JP-A-56-71060 and JP-A-55-134.

Examples of suitable cyan dyes include those described in U.S. Pat. Nos. 3,482,972, 3,929,760, 4,013,635, 4,268,625, 4,171,220, 4,242,435, 4,142,891, 4,195,994, 4,147,544 and 4,148,642, U.K. Patent 1,551,135, JP-A-54-99431, JP-A-52-8827, JP-A-53-47823, JP-A-53-143323, JP-A-54-99431, JP-A-56-71061, European Patents 53,037 and 53,040, *Research Disclosure* No. 17630 (1978) and ibid., No. 16475 (1977).

Examples of dye precursors which can be used include nondiffusible dye providing materials having a dye moiety bonded thereto, the absorption spectrum of the dye being temporarily shifted during the storage and exposure of the light-sensitive material. The term "the absorption spectrum of the dye being temporarily shifted" (hereinafter referred to as temporarily shifted dye) as used herein refers to a dye whose original absorption spectrum is changed to a different absorption spectrum when observed as an image. The temporarily shifted absorption spectrum may be restored to the original absorption spectrum at the same time when the dye is released from the nondiffusible dye providing material. The shifted absorption spectrum may be restored to the original absorption spectrum during development, irrespective of whether the dye is released. The shifted absorption spectrum may be restored to the original absorption spectrum after the dye reaches the image receiving layer by diffusion.

Usable dyes include yellow, magenta, cyan and black dyes, These dyes can be structurally classified as nitro and nitroso dyes, azo dyes (e.g., benzeneazo dyes, naphthaleneazo dyes, heterocyclic azo dyes), stilbene dyes, carbonium dyes (e.g., diphenylmethane dyes, triphenylmethane dyes, xanthene dyes, acridine dyes), quinoline dyes, methine dyes (e.g., polymethine dyes, azomethine dyes), thiazole dyes, quinoneimine dyes (e.g., azine dyes, oxazine dyes, thiazine dyes), lactone dyes, aminoketone dyes, hydroxyketone dyes, anthraquinone dyes, indigo dyes, thioindigo dyes and phthalocyanine dyes. Preferred temporarily shifted dyes are azo dyes, carbonium dyes, anthraquinone dyes, methine dyes and quinoneimine dyes. Particularly preferred are azo dyes.

Methods for forming temporarily shifted dyes which can be used in the present invention include a method wherein a dye is converted to a reduced form to hypsochromically shift the original absorption spectrum, and the shifted absorption spectrum is restored to the original absorption spectrum by oxidation during or after development (for example, azo dyes, anthraquinone dyes, methine dyes, quinoneimine dyes, indigo dyes); a method wherein the auxochrome is chemically blocked to hypsochromically shift the original absorption spectrum, and the blocking group is eliminated during development to restore the shifted absorption spectrum to the original absorption spectrum (chemical blocking method) (for example, azo dyes, carbonium dyes, methine dyes); and a method wherein after a dye reaches the image receiving layer, the dye chelates with a metal ion to thereby convert the dye into one having the desired absorption spectrum (after-chelating method) (for example, azo dyes, methine dyes, phthalocyanine dyes). The chemical blocking method and the after-chelating method are preferred in the present invention. With regard to the method wherein auxochrome is chemically blocked, examples of the method wherein the release of the dye and the removal of the blocking group are independently carried out, are described in JP-A-57-158638, JP-A-55-53329 and JP-A-55-53330. Examples of the blocking method include those described in U.S. Pat. Nos. 4,009,029, 4,310,612, 3,674,478, 3,932,480, 3,993,661, 4,335,200, 4,363,865 and 4,410,618. An example of the method wherein the release of the dye and the removal of the blocking group are simultaneously carried out, is specifically described in U.S. Pat. No. 4,783,396. Examples of the method wherein after the dye reaches the image receiving layer, chelation with a metal ion occurs to thereby change the dye to one having the desired absorption spectrum, are described in JP-A-58-209742, JP-A-58-209741, JP-A-58-17438, JP-A-58-17437, JP-A-58-17436, JP-A-57-185039, JP-A-57-58149, U.S. Pat. Nos. 4,204,993, 4,148,642 and 4,147,544, JP-A-57-158637, JP-A-58-123537, JP-A-57-181546. JP-A-60-57837, JP-A-57-182738, JP-A-59-208551, JP-A-60-37555, JP-A-59-15448, JP-A-59-149362 and JP-A-59-164553.

It is necessary for the compounds of general formula (C-II) or (C-III) themselves to be immobile in the photographic layers. Accordingly, it is desirable for a ballast group having at least 8 carbon atoms to be present at the position of EAG, $R^{101}$, $R^{102}$, $R^{104}$ or X (particularly at the position of EAG).

Typical examples of reducible dye providing compounds which can be used in the present invention include the following compounds. Dye providing compounds described in U.S. Pat. No. 4,783,396, European Patent 220,746A2 and Kokai Giho 87-6199 can also be used. The present invention, however, is not to be construed as being limited to these dyes.

(1)

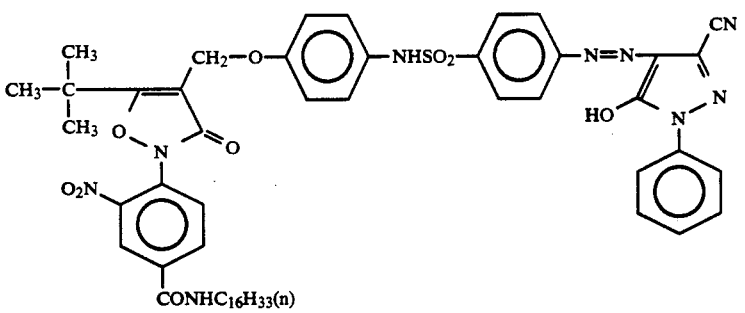

(2)

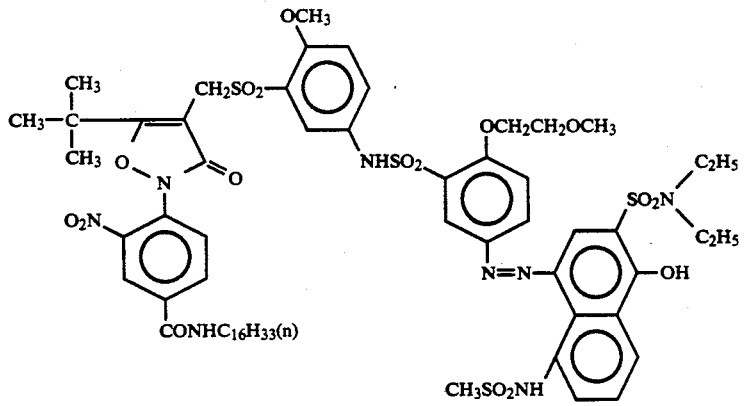

-continued
(3)
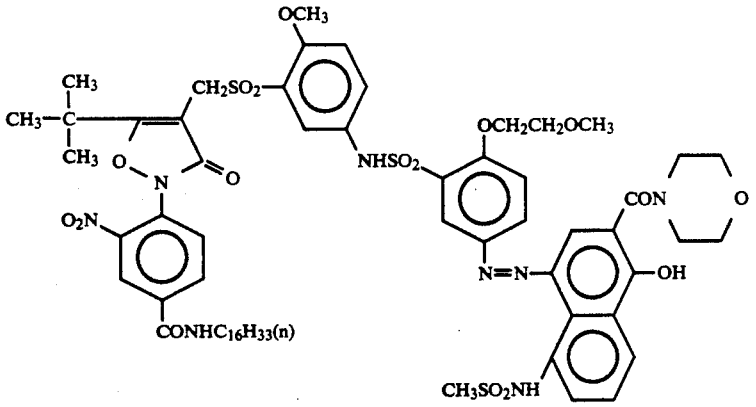
(4)
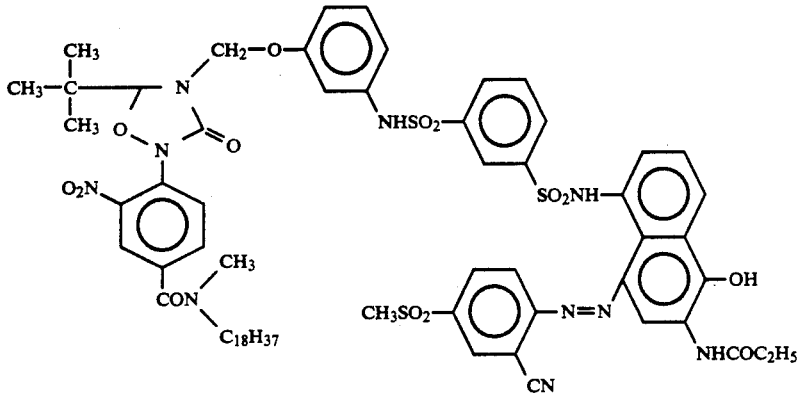
(5)
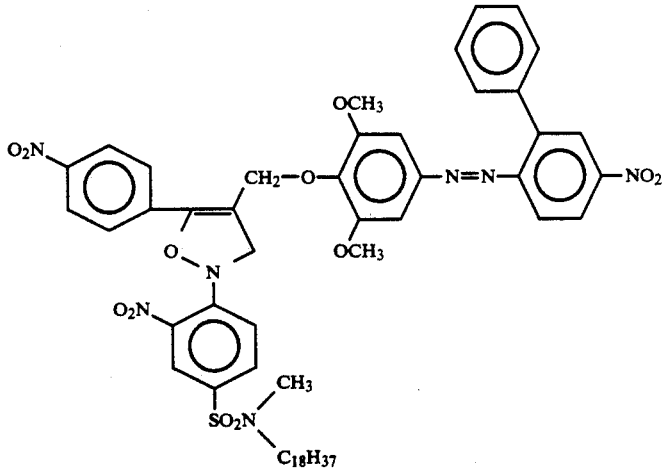
(6)
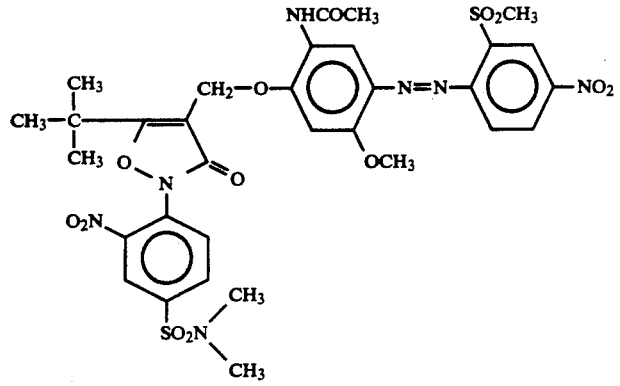

-continued
(7)
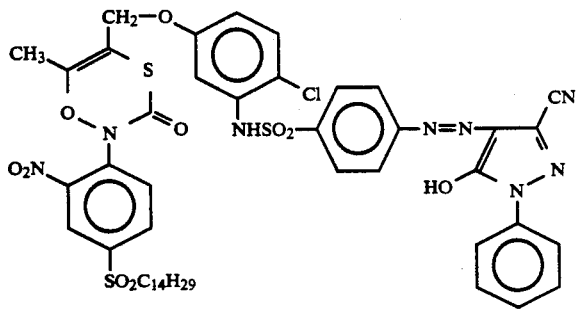
(8)
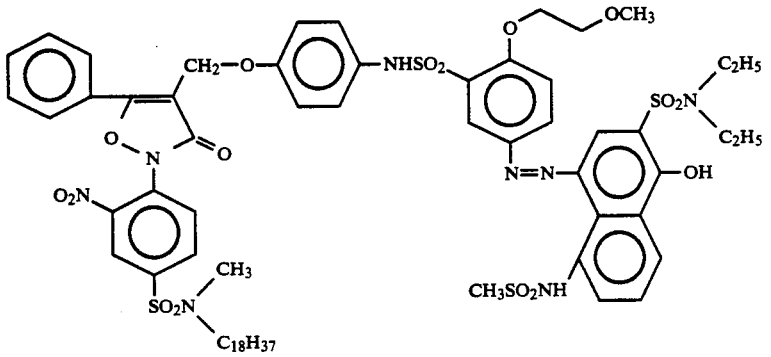
(9)
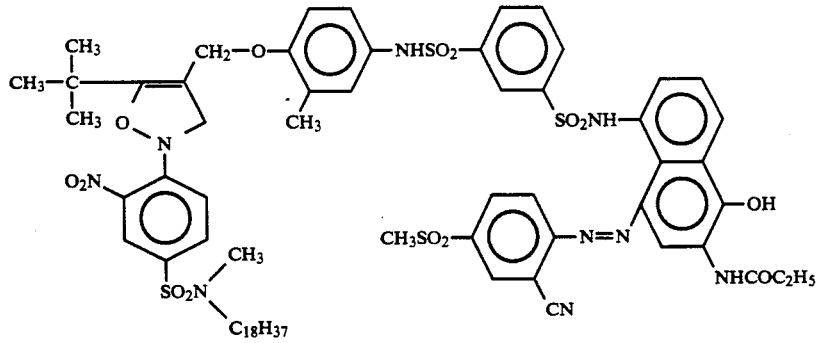
(10)
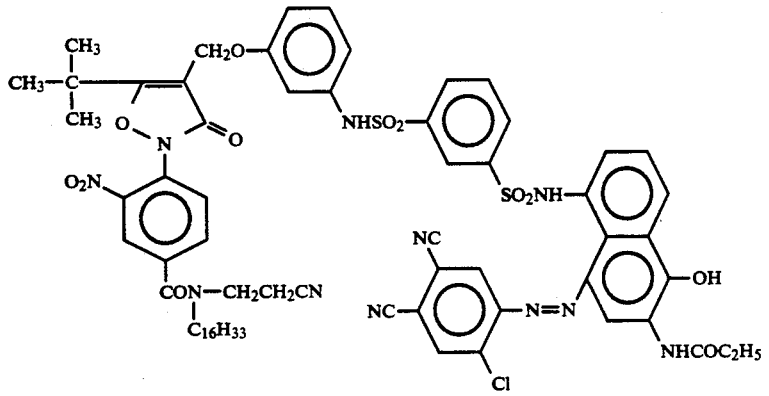

-continued
(11)
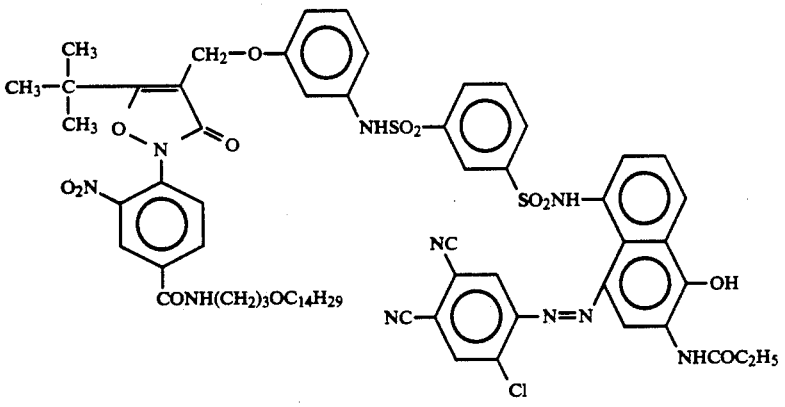
(12)
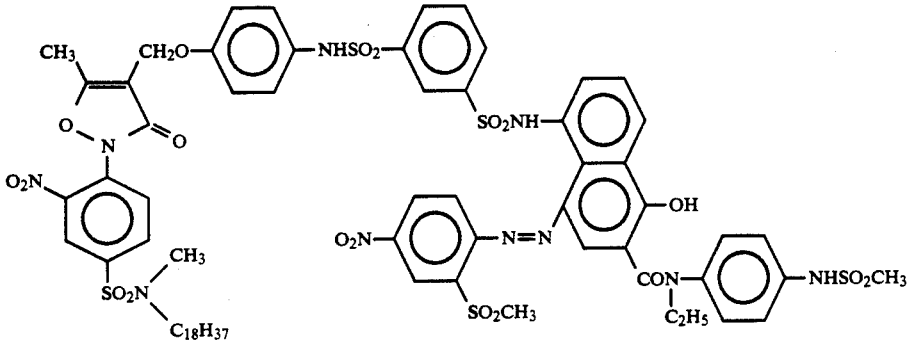
(13)
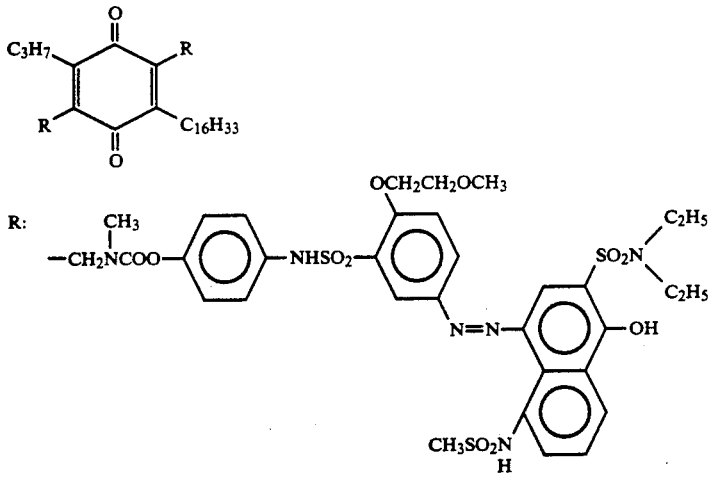
(14)
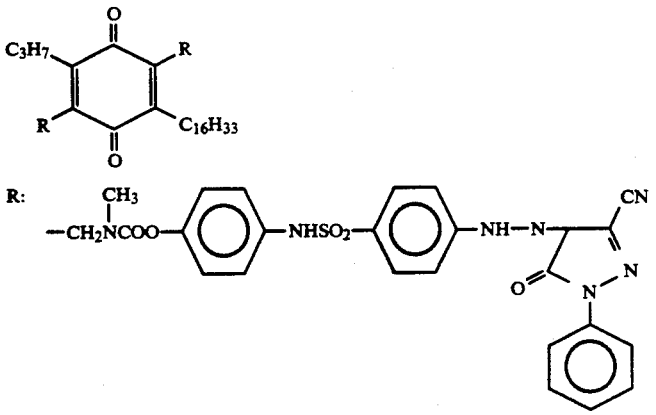

-continued (15)

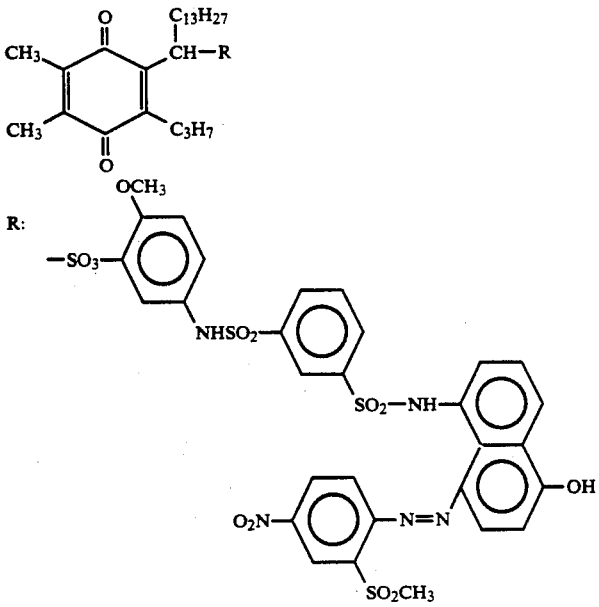

(16)

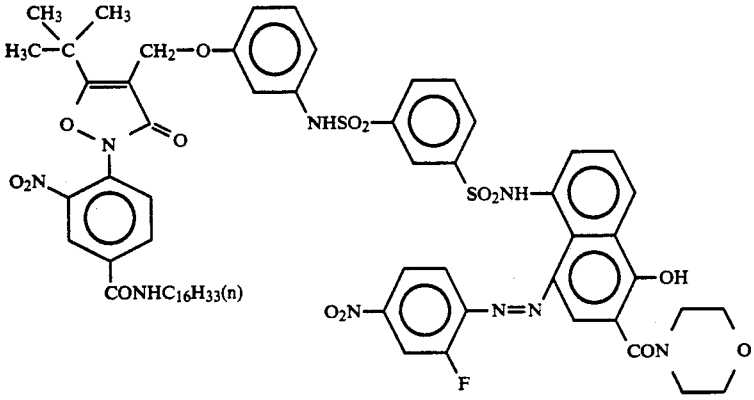

These compounds can be synthesized according to the methods described in the specifications of the above-cited patents. The amounts of the reducible dye providing compounds to be used will vary depending on the absorption coefficients of the dyes, but the amounts are in the range of generally 0.05 to 5 mmol/$m^2$, preferably 0.1 to 3 mml/$m^2$. The dye providing materials can be used either alone or as a combination of two or more thereof. Further, a mixture of two or more dye providing materials which release mobile dyes with different hues can be used to obtain an image having a dark hue or different hues. For example, a mixture of at least one member of each of cyan, magenta and yellow dye providing materials can be present in layers comprising silver halide or layers adjacent thereto as described in JP-A-60-162251.

(2) ELECTRON DONOR

Electron donors (the term "electron donor" as used herein includes an electron donor itself as well as a precursor thereof) are used in the present invention. These compounds are described in detail in U.S. Pat. No. 4,783,396, European Patent 220746A2 and Kokai Giho 87-6199. Particularly preferred examples of electron donors include compounds represented by the following general formulas (C) and (D).

(C)

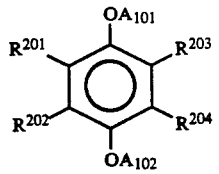

(D)

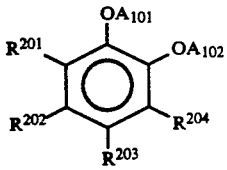

In the above general formulas, and $A_{101}$ and $A_{102}$ represent each a hydrogen atom or a protective group for a phenolic hydroxyl group, the protective group being removable by a nucleophilic reagent.

Examples of suitable nucleophilic reagents include anionic reagents such as $OH^-$, $RO^-$ (wherein R is an alkyl group or an aryl group), hydroxamic acid anions and $SO_3^{2-}$, and compounds having unpaired electrons such as primary or secondary amines, hydrazine, hydroxylamines, alcohols and thiols.

When $A_{101}$ and $A_{102}$ in general formulas (C) and (D) are each a group (hereinafter referred to as precursor group) capable of being removed by an alkali, preferred examples of $A_{101}$ and $A_{102}$ include hydrolyzable groups Such as an acyl group, an alkoxycarbonyl group, an aryloxycarbonyl group, a carbamoyl group, an imidoyl group, an oxazolyl group and a sulfonyl group; precursor groups of a type which utilizes a reverse Michael reaction as described in U.S. Pat. No. 4,009,029; precursor groups of a type which utilizes an anion as an intramolecular nucleophilic group, this anion being formed after a ring cleavage reaction as described in U.S. Pat. No. 4,310,612; precursor groups which undergo a cleavage reaction due to electron transfer of an anion through a conjugated system as described in U.S. Pat. Nos. 3,674,478, 3,932,480 and 3,993,661; precursor groups which undergo a cleavage reaction due to electron transfer of an anion reacted after ring cleavage as described in U.S. Pat. No. 4,335,200; and precursor groups utilizing an imidomethyl group as described in U.S. Pat. Nos. 4,363,865 and 4,410,618.

$A_{101}$ and $A_{102}$ may combine together with $R^{201}$, $R^{202}$, $R^{203}$ and $R^{204}$ to form a ring, if possible. $A_{101}$ and $A_{102}$ may be the same or different.

$R^{201}$, $R^{202}$, $R^{203}$ and $R^{204}$ represent each a hydrogen atom, an alkyl group, an aryl group, an alkylthio group, an arylthio group, a sulfonyl group, sulfo group, a halogen atom, a cyano group, a carbamoyl group, a sulfamoyl group, an amido group, an imido group, a carboxyl group and a sulfonamido group. These groups may optionally have one or more substituent groups.

The total carbon atoms in $R^{201}$ to $R^{204}$ is at least 8. In general formula (C), $R^{201}$ and $R^{202}$ and/or $R^{203}$ and $R^{204}$ may combine together to form a saturated or unsaturated ring. In general formula (D), $R^{201}$ and $R^{202}$, $R^{202}$ and $R^{203}$ and/or $R^{203}$ and $R^{204}$ may combine together to form a saturated or unsaturated ring.

Among the electron donors represented by general formula (C) or (D), preferred are compounds where at least two of $R^{201}$ to $R^{204}$ are each a substituent group other than a hydrogen atom. Particularly preferred are Compounds where at least one of $R^{201}$ and $R^{202}$ and at least one of $R^{203}$ and $R^{204}$ are each a substituent group other than a hydrogen atom.

Two or more electron donors may be used in combination, if desired. Further, electron donors may be used in combination with precursors thereof.

Specific examples of electron donors which can be used in this invention include, but are not limited to, the following compounds.

(ED-1)

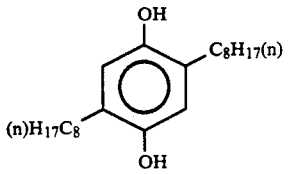

(ED-2)

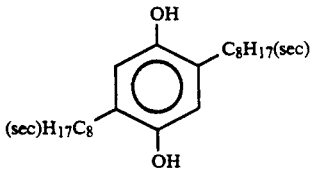

(ED-3)

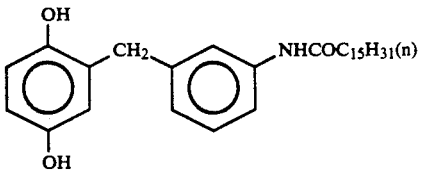

(ED-4)

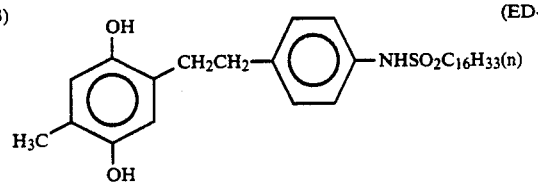

(ED-5)

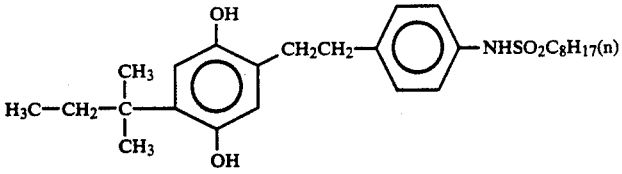

(ED-6)

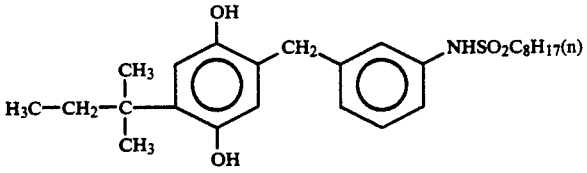

(ED-7)

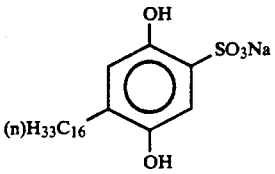

(ED-8)

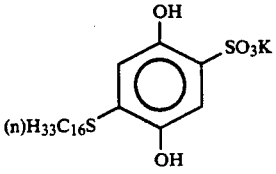

-continued (ED-9)

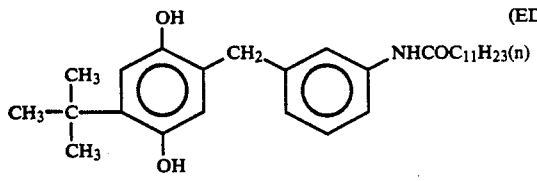

(ED-10)

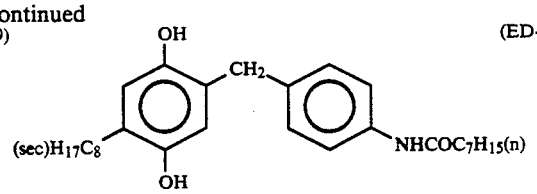

(ED-11)

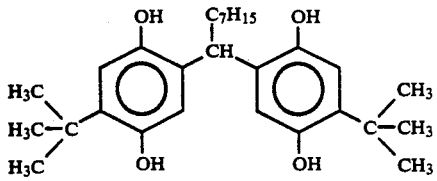

(ED-12)

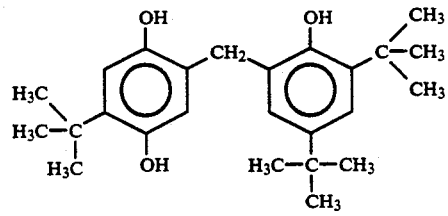

(ED-13)

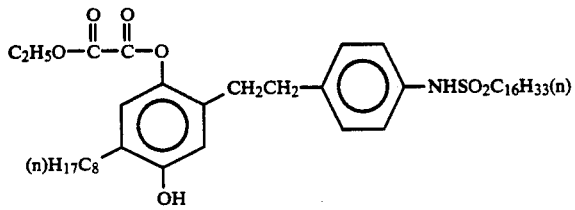

(ED-14)

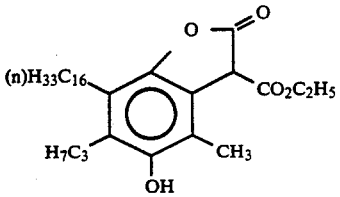

(ED-15)

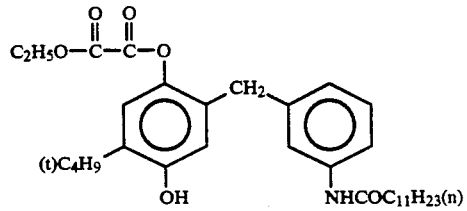

The amount of the electron donor which can be used can widely vary, but is preferably 0.01 to 50 mol, more preferably 0.1 to 5 mol per mol of the positive dye providing material and 0.001 to 5 mol, preferably 0.01 to 1.5 mol per mol of silver halide.

(3) ADDITION METHOD

The dye providing materials, the electron donors or precursors thereof and other hydrophobic additives of the present invention can be introduced into hydrophilic colloid layers according to the method described in U.S. Pat. No. 2,322,027 by using high-boiling organic solvents such as alkyl esters of phthalic acid (e.g., dibutyl phthalate, dioctyl phthalate), phosphoric esters (diphenyl phosphate, triphenyl phosphate, tricyclohexyl phosphate, tricresyl phosphate, dioctylbutyl phosphate), citric esters (e.g., tributylacetyl citrate), benzoic esters (e.g., octyl benzoate), alkylamides (e.g., diethyllaurylamide), fatty acid esters (e.g., dibutoxyethyl succinate, dioctyl azelate), trimesic esters (e.g., tributyl trimesate), carboxylic acids described in JP-A-63-85633 and compounds described in JP-A-59-83154, JP-A-59-178451, JP-A-59-178452, JP-A-59-178453, JP-A-59-178454, JP-A-59-178455 and JP-A-59-178457. The dye providing materials, the electron donors and other hydrophobic additives can also be introduced into the hydrophilic colloid layers by dissolving them in organic solvents having a boiling point of 30° to 160° C., such as lower alkyl acetates (e.g., ethyl acetate, butyl acetate), ethyl propionate, sec-butyl alcohol, methyl isobutyl ketone, β-ethoxyethyl acetate, methyl cellosolve acetate and cyclohexanone, and then dispersing the resulting solution in a hydrophilic colloid. Mixtures of the high-boiling organic solvents with the low boiling organic solvents can be used. Further, the low-boiling organic solvents can be optionally removed by ultrafiltration after dispersion. The amount of the high-boiling organic solvent to be used is not more than 10 g, preferably not more than 5 g per g of the dye providing material and not more than 5 g, preferably not more than 2 g per g of the nondiffusible reducing agent. The amount of the high-boiling organic solvent is not more than one g, preferably not more than 0.5 g, more preferably not more than 0.3 g per g of the binder. Further, dispersion methods using polymers as described in JP-B-51-39853 and JP-A-51-59943 can be used. Moreover, the dye providing materials, the electron donors and the additives can be dispersed directly in emulsions, or can be dissolved in water or alcohols and then may be dispersed in gelatin or the emulsions.

When the compounds are substantially insoluble in water, they can be present in the binder in the form of fine particles (e.g., by methods described in JP-A-59-174830, JP-A-53-102733 and JP-A-63-271339).

Various surfactants can be used when hydrophobic materials are dispersed in a hydrophilic colloid. For example, the surfactants described in JP-A-59-157636 (pp. 37–38) can be used.

(4) LIGHT-SENSITIVE SILVER HALIDE EMULSION

Any of silver chloride, silver bromide, silver iodobromide, silver chlorobromide, silver chloroiodide and silver chloroiodobromide can be used as the silver halide in the present invention. The halogen composition of the grain may be uniform throughout the whole of the grain. The grain may have a multiple structure wherein the surface layer of the grain and the interior thereof have a different halogen composition (see, JP-A-57-154232, JP-A-58-108533, JP-A-59-48785, JP-A-59-52237, U.S. Pat. No. 4,433,048 and European Patent 100,984). Tabular grains having a thickness of 0.5 μm or less, a grain size of at least 0.6 μm and an average aspect ratio of 5 or more can be used (see, U.S. Pat. Nos. 4,414,310 and 4,435,499 and German Patent (OLS) No. 3,241,646Al). Monodisperse emulsions having a nearly uniform grain size distribution may be used (see, JP-A-57-178235, JP-A-58-100846, JP-A-58-14829, WO 83/02338Al, European Patents 64,412A3 and 83,373Al).

Two or more silver halides having different crystal habits, halogen compositions, grain sizes and grain size distributions may be used in combination, if desired. Gradation can be controlled by mixing two or more monodisperse emulsions with different grain sizes.

The silver halide of the present invention can comprise grains have a mean grain size of preferably 0.001 to 10 μm, more preferably 0.001 to 5 μm.

The silver halide emulsions of the present invention can be prepared by any of the acid process, the neutral process and the ammonia process. A soluble silver salt and a soluble halide may be reacted using the single jet process, the double jet process or a combination thereof. A reverse mixing method wherein grains are formed in the presence of an excess of silver ion, or a controlled double jet process wherein pAg is kept constant can be used. The concentrations of the silver salt and the halide to be added, the amounts thereof and the addition rates thereof may be increased to expedite the growth of the grains (see, JP-A-55-142329, JP-A-55-158124, U.S. Pat. No. 3,650,757), if desired.

Silver halide grains formed by epitaxial growth can also be used (see, JP-A-56-16124, U.S. Pat. No. 4,094,684).

Ammonia, organic thioether derivatives as described in JP-B-47-11386 and sulfur-containing compounds as described in JP-A-53-144319 can be used as silver halide solvents during the course of the formation of the silver halide grains of the present invention.

Cadmium salts, zinc salts, lead salts or thallium salts may be present during the course of the formation of the grains o the physical ripening of the grains.

Water-soluble iridium salts such as iridium chloride(III, IV) and ammonium hexachloroiridate and water-soluble rhodium salts such as rhodium chloride can be used to improve high intensity reciprocity law failure and low intensity reciprocity law failure.

Soluble salts may be removed from the silver halide emulsions after the formation of the grains or physical ripening. The removal of the soluble salts can be carried out by noodle washing or by a precipitation method.

The silver halide emulsions in an un-after-ripened state may be used, but the emulsions are generally used after chemical sensitization. Emulsions for normal light-sensitive materials can be chemically sensitized using a conventional sulfur sensitization method, reduction sensitization method and noble metal sensitization method, alone or in combination. These chemical sensitization methods can be carried out in the presence of nitrogen-containing heterocyclic compounds (e.g., JP-A-58-126526, JP-A-58-215644).

The silver halide emulsions which are used in the present invention may be a surface latent image type wherein a latent image is predominantly formed on the surface of the grain or an internal latent image type wherein a latent image is predominantly formed in the interior of the grain. Direct reversal emulsions formed by combining an internal latent image type emulsion with a nucleating agent can be used. Internal latent image type emulsions suited for this purpose are described in U.S. Pat. Nos. 2,592,250 and 3,761,276, JP-B-58-3534 and JP-A-57-136641. Nucleating agents which can be advantageously used in combination with the internal latent image type emulsions in the present invention are described in U.S. Pat. Nos. 3,227,552, 4,245,037, 4,255,511, 4,266,013 and 4,276,364 and German Patent (OLS) No. 2,635,316.

The silver halide grains which can be used in the present invention can be formed by the conventional single jet process or double jet process. In the latter process, a controlled double jet process wherein the pAg in the reaction mixture is kept constant can be used. If desired, a combination thereof may be used. In the above-described methods for forming silver halide emulsions, any of a conventional one-stage addition method and a multi-stage addition method may be used. The addition rate may be constant or may be changed stepwise or continuously (e.g., using a method wherein the flow rates of a solution containing a soluble silver salt and a solution of a halide are changed while the concentrations of the silver salt and/or the halide are kept constant; a method wherein the concentrations of the silver salt and/or the halide in the solutions to be added ar changed while the flow rates are kept constant; and a combination thereof). The stirring of the reaction mixture may be carried out using conventional stirring methods. The temperature and pH of the reaction mixture during the course of the formation of the silver halide grains may be set to any value.

The coating weight of the light-sensitive silver halide of the present invention is in the range of 1 mg/m$^2$ to 10 g/m$^2$ in terms of silver.

Gelatin can be advantageously used as a protective colloid during the preparation of the emulsions of the present invention. However, other hydrophilic colloids can be used, if desired. Examples of suitable hydrophilic colloids include gelatin derivatives, graft polymers of gelatin and other high-molecular weight materials; proteins such as albumin and casein; cellulose derivatives such as hydroxyethyl cellulose, carboxymethyl cellulose and cellulose sulfate; saccharose derivatives such as sodium alginate and starch derivatives; and various hydrophilic high-molecular weight materials such as homopolymers, for example, polyvinyl alcohol, polyvinyl alcohol partial acetal, poly-N-vinylpyrrolidone, polyacrylic acid, polymethacrylic acid, polyacrylamide, polyvinylimidazole and polyvinylpyrazole and copolymers thereof.

Examples of suitable gelatins include lime-processed gelatin, acid-processed gelatin and enzyme-processed gelatin as described in *Bull. Soc. Sci. Photo. Japan*, No. 16, p. 30 (1966). Further, hydrolyzates and enzymatic hydrolyzates of gelatin can also be used.

Various anti-fogging agents or photographic stabilizers can be used in the present invention. Examples of suitable anti-fogging agents or stabilizers include azoles and azaindenes described in RD 17643, pp. 24–25 (1978); nitrogen-containing carboxylic acids and phosphoric acids described in JP-A-59-168442; mercapto compounds and metal salts thereof described in JP-A-59-111636; and acetylene compounds described in JP-A-62-87957.

Silver halide used in the present invention may be spectral-sensitized with methine dyes and other dyes. Examples of dyes which can be used include cyanine dyes, merocyanine dyes, complex cyanine dyes, complex merocyanine dyes, holopolar cyanine dyes, hemicyanine dyes, styryl dyes and hemioxonol dyes.

Specific examples of the sensitizing dyes are described in U.S. Pat. No. 4,617,257, JP-A-59-180550, JP-A-60-140335 and RD 17029, pp. 12–13 (1978).

These sensitizing dyes may be used either alone or in combination. Combinations of sensitizing dyes are often used for the purpose of supersensitization.

In addition to the sensitizing dyes, the emulsions may contain a dye which itself does not have a spectral sensitizing effect, or a compound which does substantially not absorb visible light, but has a supersensitizing effect (e.g., compounds described in U.S. Pat. No. 3,615,641, JP-A-63-23145).

These sensitizing dyes may be added to the emulsions before, during or after chemical ripening. Alternatively, the dyes may be added before or after the nucleation of the silver halide grains according to U.S. Pat. Nos. 4,183,756 and 4,225,666. The sensitizing dyes are generally used in an amount of $10^{-8}$ to $10^{-2}$ mol per mol of silver halide.

(5) CONSTITUTION OF LIGHT-SENSITIVE LAYER

A light-sensitive layer comprising at least two combinations of emulsions spectral-sensitized with the above-described spectral sensitizing dyes and the above-described dye image forming materials which provide a dye having a selective spectral absorption in the same wavelength region as that of the emulsion to reproduce natural color using subtractive color photography, is used. The emulsion and the dye image forming material may be coated as separate layers as a multi-layer structure, or may be mixed and coated as a single layer. It is preferred for the dye image forming material and the emulsion to be coated as separate layers when the dye image forming material in the coated state exhibits an absorption in the spectral sensitivity region of the emulsion to be combined with the dye image forming material. In this case, it is preferred from the viewpoint of sensitivity that the layer containing the reducible dye providing compound is provided as a lower layer under the silver halide emulsion layer. The emulsion layer may be composed of a plurality of emulsion layers having different sensitivities. An interlayer may be provided between the emulsion layer and the dye image forming material layer. A barrier layer as described in JP-B-60-15267 may be employed to increase the dye density. A reflecting layer as described in JP-A-60-91354 may be employed to increase the sensitivity of the light-sensitive element.

In a preferred embodiment of a multi-layer structure, the layers are arranged in order of a unit comprising a combination of blue-sensitive emulsions, a unit comprising a combination of green-sensitive emulsions and a unit comprising a combination of red-sensitive emulsions from the exposure side.

When the light-sensitive materials of the present invention are used as photographing materials, an ultraviolet light absorbing layer can be used as the uppermost layer of the light-sensitive layers.

Various ultraviolet light absorbers such as benztriazole compounds, 4-thiazolidone compounds and benzophenone compounds which are conventionally used in the photographic art can be used in the ultraviolet light absorbing layer.

(G) BINDER

Hydrophilic binders can be advantageously used as binders for the layers of the light-sensitive element and the image receiving element. Examples of suitable binders include those described in JP-A-62-253159 (pp. 26–28). Specifically, transparent or semitransparent binders are preferable. Examples of such binders include natural compounds such as proteins, for example, gelatin and gelatin derivatives, cellulose derivatives and polysaccharides, for example, starch, gum arabic, dextran and pullulan and synthetic high-molecular weight compounds such as polyvinyl alcohol, polyvinylpyrrolidone, acrylamide and other synthetic high-molecular weight compounds. Further, highly water-absorbing polymers such as homopolymers of vinyl monomers having —COOM or —$SO_3M$ (wherein M is hydrogen atom or an alkali metal), copolymers of two or more of these vinyl monomers and copolymers of these vinyl monomers with other vinyl monomers (e.g., sodium methacrylate, ammonium methacrylate, Sumika Gel L-5H manufactured by Sumitomo Chemical Co., Ltd.) as described in JP-A-52-245260 can be used. These binders may be used either alone or as a combination of two or more thereof.

The coating weight of the binder is preferably 20 $g/m^2$ or less, more preferably 10 $g/m^2$ or less, still more preferably 7 $g/m^2$ or less.

The constituent layers (including the back layer) of the light-sensitive element or the image receiving element may contain various polymer latexes to improve the physical properties of the layers, for example, for dimensional stability, to prevent curling or sticking from occurring, to prevent the layers from being cracked or to prevent sensitizing or desensitizing by pressure from occurring. Specifically, any of polymer latexes described in JP-A-62-245258, JP-A-62-136648 and JP-A-62-110066 can be used. When a polymer latex having a low glass transition point (not higher than 40° C.) is used in a mordant layer, the image receiving layer can be prevented from being cracked, while when a polymer latex having a high glass transition point is used in the back layer, curling can be prevented.

(H) HARDENING AGENT

Hardening agents which can be used in the layers of the light-sensitive element or the image receiving element include those described in U.S. Pat. No. 4,678,739 (41st column), JP-A-59-116655, JP-A-62-245261 and JP-A-61-18942. More specifically, examples of suitable hardening agents include aldehyde hardening agents (e.g., formaldehyde), aziridine hardening agents, epoxy hardening agents (e.g.,

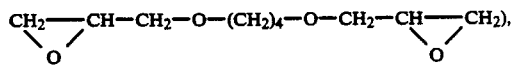

vinylsulfone hardening agents (e.g., N,N'-ethylene bis(-vinylsulfonylacetamido)ethane), N-methylol hardening agents (e.g., dimethylolurea) and high-molecular weight hardening agents (e.g., compounds described in JP-A-62-234157).

(I) OTHER MATERIALS

The layers of the light-sensitive element and the image receiving element may contain various surfactants as coating aids or to improve slipperiness, impart antistatic properties or to accelerate development. Specific examples of suitable surfactants are described in JP-A-62-173463 and JP-A-62-183457.

The layers of the light-sensitive element and the image receiving element may contain organofluoro compounds to improve slipperiness, to impart antistatic properties or to improve releasability. Typical examples of organofluoro compounds include fluorine containing surfactants, oily fluoro compounds such as fluorine-containing oils and hydrophobic fluoro compounds such as solid fluoro compound resins (e.g., tetrafluoroethylene resin) described in JP-B-57-9053 (8th to 17th columns), JP-A-61-20944 and JP-A-62-135826.

The light-sensitive element and the image receiving element may also contain matting agents. Examples of matting agents which can be used include silicon dioxide; compounds such as polyolefins and polymethacrylates described in JP-A-61-88256 (page 29); and compounds such as benzoguanamine resin beads, polycarbonate resin beads and AS resin (acrylonitrile-styrene copolymer) beads described in JP-A-63-274944 and JP-A-63-274952.

The layers of the light-sensitive element and the image receiving element may contain anti-foaming agents, antifungal and antiseptic agents, colloidal silica, etc. Specific examples of these additives are described in JP-A-61-88256 (pp. 26–32).

The light-sensitive element and/or the image receiving element of the present invention may contain image formation accelerators. Image formation accelerators function to accelerate an oxidation-reduction reaction between a silver salt oxidizing agent and a reducing agent, to accelerate reactions for forming a dye from the dye providing material, to decompose a dye or release a diffusible dye and to accelerate the transfer of a dye from the light-sensitive material layer to a dye fixing layer. Image formation accelerators can be physicochemically classified into bases or base precursors, nucleophilic compounds, high-boiling organic solvents (oils), surfactants and compounds interacting with silver or silver ion. These groups have generally a composite function, and hence these materials have always some of the above-described accelerating effects. The details of the above are described in U.S. Pat. No. 4,678,739 (38th to 40th columns).

(J) PROCESSING COMPOSITION

The processing compositions which are used in the present invention are uniformly spread over the light-sensitive element after exposure to thereby develop the light-sensitive layer with the ingredients present therein. For this purpose, the processing compositions contain alkali, thickening agent, electron transfer agent (developing agent), development accelerator for controlling development, restrainer for controlling development and antioxidant for preventing the developing agent from being deteriorated. If desired, the compositions may contain a light-intercepting screening agent.

The alkali is used to adjust the pH of processing solutions to from 12 to 14. Examples of suitable alkalis include alkali metal hydroxides (e.g., sodium hydroxide, potassium hydroxide, lithium hydroxide), alkali metal phosphates (e.g., potassium phosphate), guanidines and hydroxylated quaternary amines (e.g., tetramethylammonium hydroxide). Among them, potassium hydroxide and sodium hydroxide are preferred.

The thickening agent is used to uniformly spread the processing solution. In addition thereto, the thickening agent functions to maintain adhesion between the light-sensitive element and the image receiving element during development and to prevent the ingredients in the processing solution from being left behind on the surface of the image receiving element during peeling off.

Examples of suitable thickening agents include polyvinyl alcohol, hydroxyethyl cellulose and alkali metal salts of carboxymethyl cellulose. Hydroxyethyl cellulose and sodium carboxymethyl cellulose are preferable.

The image receiving element can contain a light-intercepting agent when the image receiving element has a transparent support and dose not have a light-intercepting function.

Any dyes or pigments can be used as the light-intercepting agents, so long as they can be diffused into the dye image receiving layer and do not cause staining. A combination thereof can also be used. A typical example of the light-intercepting agent includes carbon black. Combinations of titanium white with dyes can be used. The dyes may be temporary light-intercepting dyes which become colorless after the lapse of a given period of time from the completion of processing.

Any electron transfer agents can be used, so long as the electron donors can be cross-oxidized and stain is substantially not formed after oxidation. The electron transfer agent can be used either alone or as a combination of two or more thereof. The agents may be used in the form of their precursors, if desired. Specific examples of electron transfer agents which can be used include aminophenols and pyrazolidinones. Pyrazolidinones are preferable because stain is scarcely formed.

Examples of pyrazolidinones include 1-phenyl-3-pyrazolidinone, 1-p-tolyl-4,4-dihydroxymethyl-3-pyrazolidinone, 1-(3'-methylphenyl)-4-methyl-4-hydroxymethyl-3-pyrazolidinone, 1-phenyl-4-methyl-4-hydroxymethyl-3-pyrazolidinone and 1-p-tolyl-4-methyl-4-hydroxymethyl-3-pyrazolidinone.

The above-described processing compositions can be charged into pressure-rupturable containers and used as described in U.S. Pat. Nos. 2,543,181, 2,643,886, 2,653,732, 2,723,051, 3,056,491, 3,056,492 and 3,152,515.

(K) CONSTITUTION OF LIGHT-SENSITIVE MATERIAL

A color diffusion transfer instant light-sensitive material can be formed by combining the above-described elements.

The color diffusion transfer instant film unit can be classified into a peeling-off type and a non-peeling-off type (a unit where peeling-off can be dispensed with). In the peeling-off type unit, the light-sensitive layer and the image receiving layer are coated on separate supports. After the exposure to an image, the light-sensitive element and the dye image receiving element are put on each other, the processing composition is spread therebetween, and the dye image receiving element is then peeled therefrom, whereby a dye image transferred onto the image receiving layer can be obtained.

In the non-peeling-off type, the dye image receiving layer and the light-sensitive layer are coated between a transparent support and another support. There are two types, one with a structure where the image receiving layer and the light-sensitive layer are coated on the same transparent support, and the other with a structure where they are coated on separate supports.

In the former case, a white color reflecting layer is coated between the image receiving layer and the light-sensitive layer, while in the latter case, a white pigment is present in the processing solution to be spread between the image receiving layer and the silver halide emulsion layer. Thus a dye image transferred onto the image receiving layer can be observed with reflected light.

In the peeling-off type unit, the image receiving element and the light-sensitive element are generally coated on separate supports. The image receiving material is provided with optionally a layer having a neutralization function, a neutralization timing layer and a release layer in addition to the dye image receiving layer. It is preferred for a white support with a light-intercepting function to be used as the support for the light-sensitive material. The film unit described in JP-A-61-47956 is applicable.

Further, film units where dye image receiving layer/-release layer/light-sensitive layer in this order are coated on the same support as described in JP-A-1-198747 and JP-A-2-282253 are applicable as the peeling-off type unit.

When the light-sensitive layer and the image receiving layer are coated on the same support in the non-peeling-off type unit, a cover sheet material wherein a layer having a neutralization function and a neutralization timing layer are coated on another transparent support is used. The film units described in JP-B-46-16356 and JP-A-50-13040 are applicable.

The present invention is now illustrated in greater detail by reference to the following examples which, however, are not to be construed as limiting the invention in any way. Unless otherwise indicated herein, all parts, percents, ratios and the like are by weight.

EXAMPLE 1

(1) Preparation of Silver Halide Emulsion Having Substantially No Light Sensitivity To a well-stirred aqueous solution of 6 g of potassium bromide and 500 g of inert gelatin dissolved in 25.0 l of distilled water were added 125 ml of an aqueous solution of 25% ammonia and 250 ml of 50% ammonium nitrate. To the resulting mixture were added a 12% aqueous solution of potassium bromide and a 15% aqueous solution of silver nitrate at a constant flow rate over a period of 100 minutes by the double jet process while keeping the temperature at 60° C. and the pBr at 3.0. After desalting was carried out using the conventional flocculation method, 3500 g of inert gelatin was added thereto, and the pH was adjusted to 6.3 and the pAg was adjusted to 8.6, thus preparing Emulsion A. Emulsion A was intentionally not chemical-sensitized. Silver halide grains in Emulsion A were monodisperse cubic grains having a mean grain size of 0.3 μm.

(2) Preparation Light-Sensitive Silver Halide Emulsion

The preparation of light-sensitive silver halide emulsion (1) (for a blue-sensitive emulsion layer) is illustrated below.

The following solutions (1) and (2) were simultaneously added to a well-stirred aqueous gelatin solution (formed by adding 20 g of gelatin, 3 g of potassium bromide and 0.3 g of $HO(CH_2)_2S(CH_2)_2S(CH_2)_2OH$ and with the temperature being kept at 55° C.) over a period of 30 minutes. Subsequently, the following solutions (3) and (4) were simultaneously added thereto over a period of 20 minutes. Five minutes after the commencement of the addition of the solutions (3) and (4), the following dye solution was added thereto over a period of 18 minutes.

After washing with water and desalting, 20 g of lime-processed ossein gelatin was added thereto to adjust the pH to 6.2 and the pAg to 8.5. Sodium thiosulfate, 4-hydroxy-6-methyl-1,3,3a,7-tetrazaindene and chloroauric acid were then added thereto for optimum chemical sensitization. In this way, 600 g of a monodisperse tetradecahedral silver iodobromide emulsion having a mean grain size of 0.40 μm was obtained.

| | | Solution (1) 180 cc volume by adding water | Solution (2) 180 cc volume by adding water | Solution (3) 350 cc volume by adding water | Solution (4) 350 cc volume by adding water |
|---|---|---|---|---|---|
| $AgNO_3$ | (g) | 30 g | — | 70 g | — |
| KBr | (g) | — | 2.0 g | — | 49 g |
| KI | (g) | — | 1.8 g | — | — |

DYE SOLUTION

A solution of the following dyes dissolved in 160 cc of methanol.

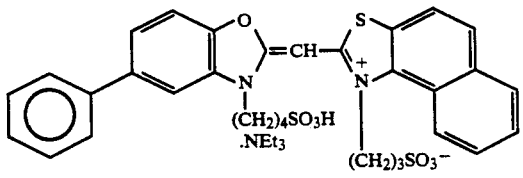

0.12 g

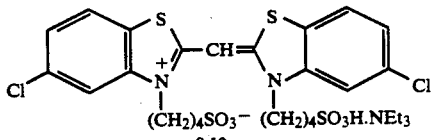

0.12 g

The preparation of light-sensitive silver halide emulsion (2) (for a green-sensitive emulsion) is illustrated below.

The following solutions (I) and (II) were simultaneously added to a well-stirred aqueous solution (formed by adding 20 g of gelatin, 0.30 g of potassium bromide, 6 g of sodium chloride and 0.015 g of Reagent A below to 730 ml of water and with the temperature thereof being kept at 60.0° C.) at an equal flow rate over a period of 60 minutes. After completion of the addition of the solutions (I) and (II), the solution (III) (a methanol solution of the following dye) was added thereto. In this way, a monodisperse cubic emulsion having a mean grain size of 0.45 μm and containing the dye adsorbed thereon was prepared.

After washing with water and desalting, 20 g of gelatin was added thereto to adjust the pH to 6.4 and the pAg to 7.8. Chemical sensitization was then carried out at 60.0° C. The reagents used for chemical sensitization were 1.6 mg of triethylthiourea and 100 mg of 4-hydroxy-6-methyl-1,3,3a,7-tetrazaindene, and the ripening time was 55 minutes. The yield of the emulsion was 635 g.

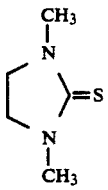

Reagent A

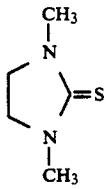

Reagent A

Sensitizing Dye C

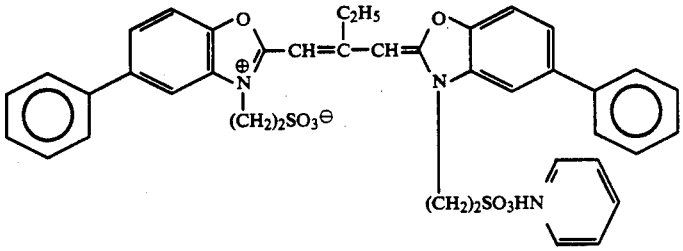

| | Solution (I) total volume of 400 ml by adding water | Solution (II) total volume of 400 ml by adding water | Solution (III) total volume of 77 ml by adding methanol |
|---|---|---|---|
| $AgNO_3$ | 100.0 g | — | — |
| KBr | — | 56.0 g | — |
| NaCl | — | 7.2 g | — |
| Dye C | — | — | 0.23 g |

The preparation of light-sensitive silver halide Emulsion (3) (for a red-sensitive emulsion layer) is illustrated below.

The following solutions (I) and (II) were simultaneously added to a well-stirred aqueous gelatin solution (formed by adding 20 g of gelatin, 0.3 g of potassium bromide, 6 g of sodium chloride and 30 mg of the following Reagent A to 800 ml of water and with the temperature thereof being kept at 65° C.) at an equal flow rate over a period of 30 minutes. Subsequently, the following solutions (III) and (IV) were added thereto over a period of 30 minutes. Three minutes after the commencement of the addition of the solutions (III) and (IV), 100 ml of the following dye solution was added thereto over a period of 20 minutes.

After washing with water and desalting, 22 g of lime-processed ossein gelatin was added thereto to adjust the pH to 6.0 and the pAg to 7.7. Subsequently, sodium thiosulfate, 4-hydroxy-6-methyl-1,3,3a,7-tetrazaindene and chloroauric acid were added thereto, and optimal chemical sensitization was conducted at 60° C. In this way, a monodisperse cubic silver chlorobromide emulsion having a mean grain size of 0.5 μm was obtained. Yield: 635 g.

| | 200 ml volume by adding water | 200 ml volume by adding water |
|---|---|---|
| | Solution (I) | Solution (II) |
| $AgNO_3$ (g) | 50.0 g | — |
| KBr | — | 28.0 g |
| NaCl | — | 3.4 g |
| | Solution (III) | Solution (IV) |
| $AgNO_3$ (g) | 50.0 g | — |
| KBr | — | 35.0 g |

DYE SOLUTION

A solution of 67 mg of the Dye (a) below and 133 mg of the Dye (b) below dissolved in 200 ml of methanol.

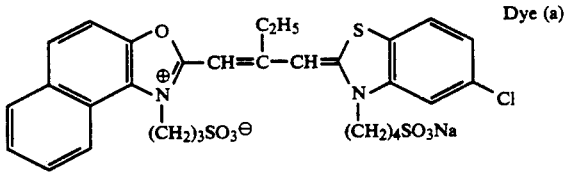

Dye (a)

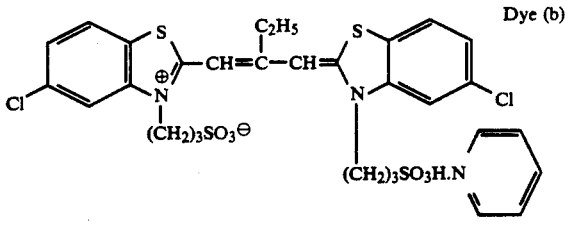

Dye (b)

(3) Preparation of Gelatin Dispersions of Dye Providing Material, Electron Donor and Nondiffusible Reducing Agent for Interlayer The preparation of the gelatin dispersion of the dye providing material is illustrated below.

18 g of the yellow dye providing material (1)* and 12 g of the high-boiling organic solvent (1)* were weighed, and 51 mg of ethyl acetate was added thereto. The mixture was heated to about 60° C. to dissolve them and to obtain a uniform solution. The resulting solution, 100 g of a 10% solution of lime-processed gelatin, 60 cc of water and 1.5 g of sodium dodecylbenzenesulfonate were mixed with stirring and dispersed in a homogenizer at 10,000 rpm for 10 minutes. The resulting dispersion was referred to as a dispersion of a yellow dye providing material.

The dispersion of each of a magenta dye providing material and a cyan dye providing material was prepared in the same manner as in the preparation of the dispersion of the yellow dye providing material except that magenta dye providing material (2)* or cyan dye providing material (3)* was used.

The preparation of the gelatin dispersion of the electron donor is illustrated below.

120 ml of ethyl acetate was added to 20.6 g of the electron donor (1)* and 13.1 g of the high-boiling organic solvent (1)* were weighed. The mixture was heated to about 60° C. to dissolve them and to form a uniform solution. The resulting solution, 100 g of a 10% solution of lime-processed gelatin, 60 cc of water and 1.5 g of sodium dodecylbenzenesulfonate were mixed with stirring and dispersed in a homogenizer at 10,000 rpm for 10 minutes. The resulting dispersion is referred to as a dispersion of an electron donor.

The preparation of the gelatin dispersion of the nondiffusible reducing agent for an interlayer is illustrated below.

23.5 g of the nondiffusible reducing agent (1)* and 8.5 g of the high-boiling organic solvent (1)* were dissolved in 120 ml of ethyl acetate at about 60° C. to form a uniform solution. The resulting solution, 100 g of a 10% aqueous solution of lime-processed gelatin, 15 ml of a 5% aqueous solution of 0.2 g of dodecylbenzenesulfonic acid were mixed with stirring and dispersed in a homogenizer at 10,000 rpm for 10 minutes. The resulting dispersion was referred to as a dispersion of a nondiffusible reducing agent for an interlayer.

Matting Agent:
Latex of spherical particles of polymethyl methacrylate (average particle size: 4 μm)

Ultraviolet Light Absorber (1)*:

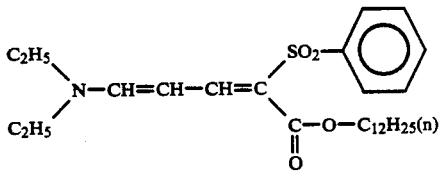

Ultraviolet Light Absorber (2)*:

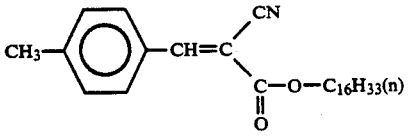

Water-Soluble Polymer (1)*:

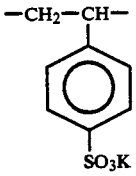

Average M.W. = 100,000

Surfactant (1)*:
Aerosol OT

Surfactant (2)*:

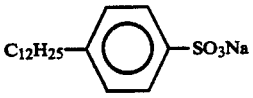

High-boiling Organic Solvent (1)*:
Tricyclohexyl phosphate

Hardening Agent (1)*:
1,2-bis(Vinylsulfonylacetamido)ethane

Nondiffusible Reducing Agent (1)*:

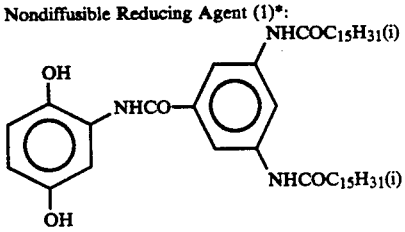

Electron Donor (1)*:

-continued

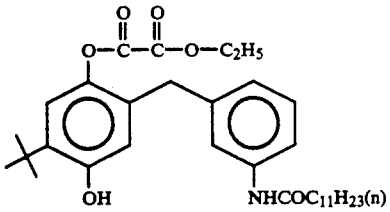

Yellow Dye Providing Material (1)*:

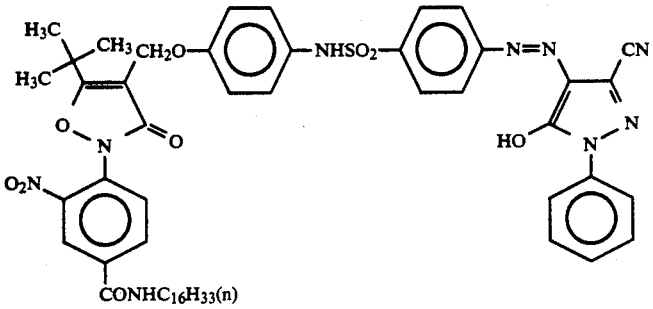

Magenta Dye Providing Material (2)*:

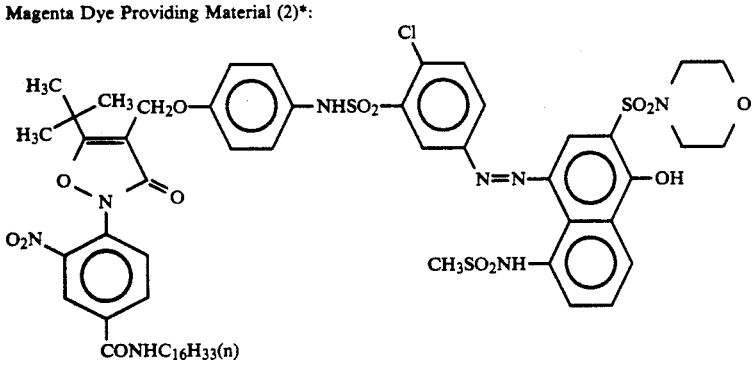

Cyan Dye Providing Material (3)*

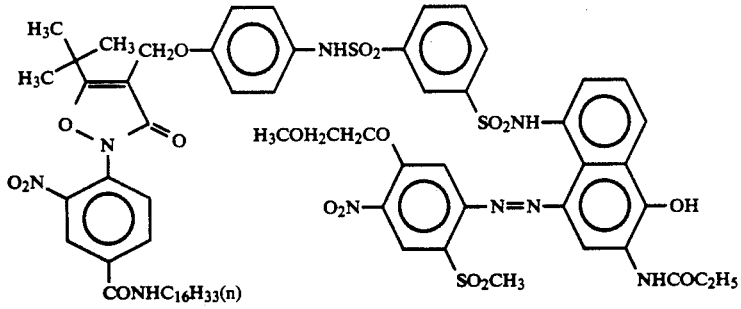

(4) Preparation of Comparative Light-Sensitive Element (101)

Comparative light-sensitive element (101) having the structure given in Table 1 was prepared using the emulsion obtained in item (2) above and the gelatin dispersions of the dye providing material, the electron donor and the nondiffusible reducing agent for the interlayer prepared in item (3) above.

TABLE 1

| Layer No. | Layer | Additive | Amount added ($g/m^2$) |
|---|---|---|---|
| Fifth Layer | Protective Layer | Gelatin | 0.17 |
| | | Matting Agent (1) | 0.09 |
| | | Hardening Agent (1) | $1.9 \times 10^{-3}$ |

TABLE 1-continued

| Layer No. | Layer | Additive | Amount added ($g/m^2$) |
|---|---|---|---|
| | | Surfactant (1) | $4.5 \times 10^{-4}$ |
| | | Surfactant (2) | $5.0 \times 10^{-5}$ |
| | | Water-Soluble Polymer (1) | $3.6 \times 10^{-4}$ |
| Fourth Layer | Ultraviolet Light Absorbing Layer | Gelatin | 0.47 |
| | | Ultraviolet Light Absorber (1) | 0.14 |
| | | Ultraviolet Light Absorber (2) | 0.13 |
| | | Surfactant (1) | $1.3 \times 10^{-3}$ |
| | | Water-Soluble Polymer (1) | $1.4 \times 10^{-4}$ |
| Third Layer | Interlayer | Nondiffusible Reducing Agent (1) | 0.45 |

TABLE 1-continued

| Layer No. | Layer | Additive | Amount added ($g/m^2$) |
|---|---|---|---|
| | | High-Boiling Organic Solvent (1) | 0.16 |
| | | Gelatin | 0.68 |
| | | Surfactant (1) | $6.5 \times 10^{-2}$ |
| | | Water-Soluble Polymer (1) | $1.9 \times 10^{-2}$ |
| Second Layer | Light-Sensitive Layer | Emulsion (3) (in terms of Ag) | 0.23 |
| | | Gelatin | 0.34 |
| | | Surfactant (1) | $6.7 \times 10^{-3}$ |
| | | Water-Soluble Polymer (1) | $1.4 \times 10^{-2}$ |
| First Layer | Cyan Dye Material Layer | Cyan Dye Providing Material (3) | 0.38 |
| | | Electron Donor (1) | 0.13 |
| | | Gelatin | 0.38 |
| | | High-Boiling Organic Solvent (1) | 0.27 |
| | | Water-Soluble Polymer (1) | $4.3 \times 10^{-3}$ |
| Support (polyethylene terephthalate of 100 μm) | | | |
| | Back Layer | Carbon Black | 4.0 |
| | | Gelatin | 2.0 |

(5) Preparation of Light-Sensitive Element Sample (102) (present invention)

Sample (102) was prepared in the same manner as in the preparation of Sample (101) except that Emulsion A prepared in item (1) above in an amount of 0.11 $g/m^2$ (in terms of Ag) was added to the First Layer.

(6) Preparation of Light-Sensitive Element Sample (103) (for evaluation)

Sample (103) was prepared in the same manner as in the preparation of Sample (102) except that Emulsion (3) used in the Second Layer was omitted.

(7) Preparation of Image Receiving Element

The image receiving element was prepared in the following manner.

Paper Support:

Both sides of a paper of a thickness of 150 μm were laminated with polyethylene in a thickness of 30 μm. The polyethylene on the image receiving layer side contained 10% by weight (based on the weight of polyethylene) of titanium oxide dispersed therein.

Back Side:

(a) Light-intercepting layer comprising carbon black (4.0 $g/m^2$) and gelatin (2.0 $g/m^2$)

(b) White color layer comprising titanium oxide (8.0 $g/m^2$) and gelatin (1.0 $g/m^2$)

(c) Protective layer comprising gelatin (0.6 $g/m^2$)

Coating was in the order of (a) to (c), and these layers were hardened with a hardening agent Image Receiving Layer Side (1) Neutralization layer comprising an acrylic acid-butyl acrylate copolymer (8:2 by mol) having an average molecular weight of 50,000 in an amount 22 $g/m^2$.

(2) Second timing layer comprising 4.5 $g/m^2$ of the combined amount of cellulose acetate having a degree of oxidation of 51.3% (the weight of acetic acid released by hydrolysis being 0.513 g per gram of sample) and a styrene-maleic anhydride (1:1 by mol) copolymer having an average molecular weight of about 10,000 wherein the ratio of cellulose acetate to the copolymer was 95:5 by weight.

(3) Interlayer comprising 0.4 $g/m^2$ of poly-2-hydroxyethyl methacrylate.

(4) First timing layer comprising 6 $g/m^2$ (on a total solids basis) of a blend of a polymer latex obtained by emulsion polymerizing styrene-butyl acrylate-acrylic acid-N-methylol acrylamide in a ratio of 49.7/42.3/4/4 by weight with a polymer latex obtained by emulsion polymerizing methyl methacrylate/acrylic acid/N-methylol acrylamide in a ratio of 93/3/4 by weight wherein the ratio of the former polymer latex to the latter polymer was 6:4 on a solids basis.

(5) Image receiving layer formed by coating 3.0 $g/m^2$ of a polymer mordant having the following repeating unit

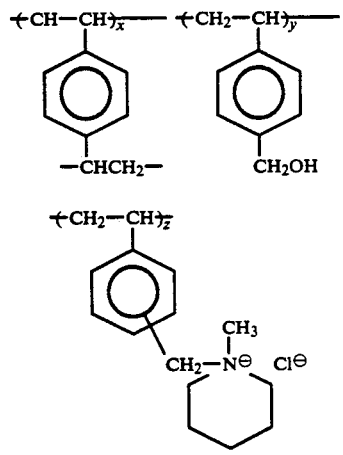

x:y:z = 5:5:90
Average M.W. = 300,000 and 3.0 $g/m^2$ of gelatin using the following compound as a coating aid.

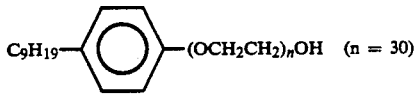

(6) Protective layer comprising 0.6 $g/m^2$ of gelatin.

Layers (1) to (6) above in this order were coated and hardened with a hardening agent.

(8) Preparation of Processing Element

A processing solution having the following composition was charged into a container capable of being ruptured by a pressure of 0.8 g.

| | |
|---|---|
| 1-p-Tolyl-4-hydroxymethyl-4-methyl-3-pyrazolidone | 10.0 g |
| 1-Phenyl-4-hydroxymethyl-4-methyl-3-pyrazolidone | 4.0 g |
| Potassium Sulfite (anhydrous) | 4.0 g |
| Hydroxyethyl Cellulose | 40 g |
| Potassium Hydroxide | 64 g |
| Benzyl Alcohol | 2.0 g |
| Add water to make total amount | 1 kg |

The above light-sensitive element Samples (101) and (102) were exposed through a filter, whose density continuously changed by 4.0, at 5000 lx for 1/100 sec by using a tungsten lamp. Each of the samples was then put on the image receiving layer side of the image receiving element. The above processing solution was spread therebetween using a press roller so that the solution was spread in a thickness of 60 μm. The processing was carried out at 25° C. After 1.5 minutes and 5 minutes, the light-sensitive element and the image receiving element were peeled from each other. The reflection density of the image transferred onto the image receiving element was measured with a color densitometer. The results obtained are shown in Table 2 below.

TABLE 2

| Sample No. | Dmax | Dmin | Density of Re-Reversed Area |
|---|---|---|---|
| | Peeled after 1.5 min | | |
| (101) Comparative Sample | 2.20 | 0.21 | 0.40 |
| (102) Invention | 2.19 | 0.15 | Re-reversal not occur |
| | Peeled after 5 min | | |
| (101) Comparative Sample | 2.25 | 0.27 | 0.62 |
| (102) Invention | 2.25 | 0.16 | 0.17 |

It has been found that according to the present invention, the minimum density is low, an increase in minimum density scarcely occurs even when the time elapsed until peeling off is prolonged, and a phenomenon (re-reversal phenomenon), wherein the density in the high exposure region is again increased, can be prevented.

Evaluation of Silver Halide Emulsion (Emulsion A) having Substantially No Light Sensitivity Light-sensitive element Sample (103) for evaluation was processed under the same conditions as those above under which Samples (101) and (102) were processed. The optical density of Sample (103) exposed in the range of an exposure amount of from log $I_1$=log $I_0$+0.5 to log $I_2$ =log $I_0$+2.0 (wherein $I_0$ is the minimum exposure amount providing a minimum density of the positive image of Sample (102)) and the optical density of the unexposed sample were identical with each other within a range of ±10%. Accordingly, it was considered that Emulsion A was a silver halide emulsion having substantially no light sensitivity within the scope of the present invention.

EXAMPLE 2

A multi-layer light-sensitive element Sample (201) shown in Table 3 was prepared and evaluated in the same manner as in Example 1. A similar effect to that of Example 1 was obtained.

TABLE 3

| Layer No. | Layer | Additive | Amount added (g/m²) |
|---|---|---|---|
| Twelfth Layer | Protective Layer | Gelatin | 0.17 |
| | | Matting Agent (1) | 0.09 |
| | | Hardening Agent (1) | $1.9 \times 10^{-3}$ |
| | | Surfactant (1) | $4.5 \times 10^{-4}$ |
| | | Surfactant (2) | $5.0 \times 10^{-5}$ |
| | | Water-Soluble Polymer (1) | $3.6 \times 10^{-4}$ |
| Eleventh Layer | Ultraviolet Light Absorbing Layer | Gelatin | 0.47 |
| | | Ultraviolet Light Absorber (1) | 0.14 |
| | | Ultraviolet Light Absorber (2) | 0.13 |
| | | Surfactant (1) | $1.3 \times 10^{-3}$ |
| | | Water-Soluble Polymer (1) | $1.4 \times 10^{-4}$ |

TABLE 3-continued

| Layer No. | Layer | Additive | Amount added (g/m²) |
|---|---|---|---|
| Tenth Layer | Blue-Sensitive Layer | Emulsion (1) (in terms of Ag) | 0.23 |
| | | Emulsion A (in terms of Ag) | 0.11 |
| | | Gelatin | 0.34 |
| | | Surfactant (1) | $6.7 \times 10^{-3}$ |
| | | Water-Soluble Polymer (1) | $1.4 \times 10^{-2}$ |
| Ninth Layer | Yellow Dye Material Layer | Yellow Dye Providing Material (1) | 0.37 |
| | | Electron Donor (1) | 0.20 |
| | | Gelatin | 0.53 |
| | | High-Boiling Organic Solvent (1) | 0.37 |
| | | Water-Soluble Polymer (1) | $6.5 \times 10^{-3}$ |
| Eighth Layer | Gelatin layer | Gelatin | 0.68 |
| | | Surfactant (1) | $2.3 \times 10^{-2}$ |
| | | Water-Soluble Polymer (1) | $2.3 \times 10^{-2}$ |
| Seventh Layer | Interlayer | Nondiffusing Reducing Agent | 0.45 |
| | | High-Boiling Organic Solvent | 0.16 |
| | | Gelatin | 0.68 |
| | | Surfactant (1) | $6.5 \times 10^{-2}$ |
| | | Water-Soluble Polymer (1) | $1.9 \times 10^{-2}$ |
| Sixth Layer | Green-Sensitive Layer | Emulsion (2) (in terms of Ag) | 0.23 |
| | | Emulsion A (in terms of Ag) | 0.11 |
| | | Gelatin | 0.34 |
| | | Surfactant (1) | $6.7 \times 10^{-3}$ |
| | | Water-Soluble Polymer (1) | $1.4 \times 10^{-2}$ |
| Fifth Layer | Magenta Dye Material Layer | Magenta Dye Providing Material (2) | 0.33 |
| | | Electron Donor (1) | 0.13 |
| | | Gelatin | 0.38 |
| | | High-Boiling Organic Solvent (1) | 0.27 |
| | | Water-Soluble Polymer (1) | $4.3 \times 10^{-3}$ |
| Fourth Layer | Gelatin Layer | Gelatin | 0.68 |
| | | Surfacant (1) | $2.3 \times 10^{-2}$ |
| | | Water-Soluble Polymer (1) | $2.3 \times 10^{-2}$ |
| Third Layer | Interlayer | Nondiffusible Reducing Agent (1) | 0.45 |
| | | High-Boiling Organic Solvent (1) | 0.16 |
| | | Gelatin | 0.68 |
| | | Surfactant (1) | $6.5 \times 10^{-2}$ |
| | | Water-Soluble Polymer (1) | $1.9 \times 10^{-2}$ |
| Second Layer | Red-Sensitive Layer | Emulsion (3) (in terms of Ag) | 0.23 |
| | | Emulsion A (in terms of Ag) | 0.11 |
| | | Gelatin | 0.34 |
| | | Surfactant (1) | $6.7 \times 10^{-3}$ |
| | | Water-Soluble Polymer (1) | $1.4 \times 10^{-2}$ |
| First Layer | Cyan Dye Material Layer | Cyan Dye Providing Material (3) | 0.38 |
| | | Electron Donor (1) | 0.13 |
| | | Gelatin | 0.38 |
| | | High-Boiling Organic Solvent (1) | 0.27 |
| | | Water-Soluble Polymer (1) | $4.3 \times 10^{-3}$ |
| Support (polyethylene terephthalate of 100 μm) | | | |
| | Back Layer | Carbon Black | 4.0 |
| | | Gelatin | 2.0 |

The mechanism of effect of the silver halide emulsion having substantially no light sensitivity used in the present invention is not at present clear. However, since the effect thereof can be obtained with an exposure amount for the exposure of the light-sensitive silver halide emulsion and a larger effect can be obtained by a longer development time, the effect of the present invention is thought to be due a mechanism where after development of the light-sensitive silver halide emulsion is completed, the development of the silver halide emulsion having substantially no light sensitivity occurs (generally called developer fog development), and an increase in minimum density occurs due to a reducing material (material formed by re-reducing the oxidation product of an electron donor by an electron transfer agent, or an electron transfer agent itself) present in the latter stage of development, is inhibited by the formation of the oxidation product of an electron transfer agent formed by the above-described development of the silver halide emulsion having substantially no light sensitivity. However, it should be noted that the spirit of the present invention is not limited to the above-described hypothesis.

While the invention has been described in detail and with reference to specific embodiments thereof, it will be apparent to one skilled in the art that various changes and modifications can be made therein without departing from the spirit and the scope of the present invention.

What is claimed is:

1. A color diffusion transfer light-sensitive material comprising a support having thereon light-sensitive silver halide emulsions and an electron donor in combination with reducible dye providing compounds each of which releases a diffusible dye when reduced and, further, a silver halide emulsion having substantially no light sensitivity in addition to the light-sensitive silver halide emulsions.

2. A color diffusion transfer light-sensitive material as in claim 1, wherein said reducible dye providing compounds are compounds represented by the following general formula (C-I):

$$\text{PWR}-(\text{Time})_t-\text{Dye} \qquad \text{(C-I)}$$

wherein PWR represents a group which releases $-(\text{Time})_t-\text{Dye}$ when reduced; Time represents a group which releases Dye through a subsequent reaction after $-(\text{Time})_t-\text{Dye}$ is released from PWR; t represents an integer of 0 or 1; and Dye represents a dye or a precursor thereof.

3. A color diffusion transfer light-sensitive material as in claim 1, wherein said silver halide emulsion having substantially no light sensitivity is present in an amount of 5% to 200%, in terms of silver, based on the amount of the light-sensitive silver halide emulsion.

4. A color diffusion transfer unit comprising a color diffusion transfer light-sensitive material as in claim 1 and an alkaline processing solution containing an electron transfer agent in a rupturable container.

* * * * *